US006966158B1

(12) United States Patent
Christensen

(10) Patent No.: US 6,966,158 B1
(45) Date of Patent: Nov. 22, 2005

(54) UNIVERSAL WINDOW/DOOR FRAME

(76) Inventor: Ed Christensen, 4-939 Kuhio Hwy., # B-C-D-E, Kapaa, HI (US) 96746

( * ) Notice: Subject to any disclaimer, the term of this patent is extended or adjusted under 35 U.S.C. 154(b) by 127 days.

(21) Appl. No.: 10/238,111

(22) Filed: Sep. 10, 2002

(51) Int. Cl.[7] ..... E06B 1/04

(52) U.S. Cl. ..... 52/213; 52/207; 52/204.1; 52/210; 52/212; 52/98; 52/204.54; 52/204.595; 52/204.6; 49/504; 49/505

(58) Field of Search ..... 52/204.1, 204.2, 52/206–207, 210, 212, 98, 204.53, 204.54, 52/204.57, 664, 213, 205, 204.591, 204.595, 52/204.6, 204.62, 204.63, 204.69, 204.7; 49/504, 505

(56) References Cited

U.S. PATENT DOCUMENTS 4,351,131 A * 9/1982 Kubik ..... 49/501
4,569,154 A * 2/1986 Bayer ..... 49/504
4,742,647 A * 5/1988 Pacca ..... 49/505
4,944,118 A * 7/1990 Biro ..... 49/504
5,014,466 A * 5/1991 Winner ..... 49/504
5,713,167 A * 2/1998 Durham et al. ..... 52/204.54
6,041,560 A * 3/2000 Larson et al. ..... 52/204.54
6,067,754 A * 5/2000 Bellart ..... 49/453
6,763,638 B1 * 7/2004 Berger, Jr. ..... 52/204.6

* cited by examiner

*Primary Examiner*—Jeanette E. Chapman
(74) *Attorney, Agent, or Firm*—Michael I Kroll

(57) ABSTRACT

The invention discloses a universal window/door frame comprised of a group of components that can be used singularly or in combination to form a plurality of window/door types. The components forming the various window and door types are a frame, sash and T-bar of standard thickness that forms the frame and glass holding elements of the window or door. The hardware defining the window type uses one or more of a plurality of concealed channels contained within the frame. When necessary, access to and use of the channels is obtained by removing material forming the interior wall of the frame providing access to the concealed channel or channels that will be used to define the windows functional components, such as having a screen or a sliding member. Some types, i.e. jalousie and direct set picture windows, do not require the use of the concealed channels. The use of the T-bar provides for the inclusion of various window types having the potential for common glass lines on the vertical and horizontal.

27 Claims, 36 Drawing Sheets

UNIVERSAL WINDOW/DOOR FRAME

BACKGROUND OF THE INVENTION

1. Field of the Invention

The present invention relates generally to window and door frames and, more specifically, to a universal window/door frame comprised of a group of components that can be used singularly or in combination to form a plurality of window/door types. The components forming the various window and door types are a frame, sash and t-bar of standard thickness that forms the frame and glass holding elements of the window or door. Most ancillary hardware defining the window type uses one or more of a plurality of concealed channels contained within the frame. When necessary, access to and use of the channels is obtained by removing material forming the interior wall of the frame providing access to the concealed channel or channels that will be used to define the windows functional components, such as having a screen or a sliding member. Some types, i.e. jalousie and direct set picture windows, do not require the use of the concealed channels.

The frame has an exterior wall and spaced apart interior walls with an interior structural framework that is appropriate for the application of the frame. Also concealed between the spaced apart walls are a plurality of channels that can be used by removing, such as by cutting, the covering material. The channels are exposed and used as needed by the particular window type. A sliding glass window may use one channel. The addition of a sliding screen member would use an additional channel. No channel is used in certain instances such as a picture window or a jalousie window. The plurality of channels also provides for selective placement of the window members. A double hung window could be positioned to the interior or the exterior of the frame to accommodate additional components or to achieve a particular design effect. It should also be noted that while the preferred embodiment would have a depth substantially equal to the normal wall construction width of an interior and exterior wall covering spaced by a 2×4 thereby no interior or exterior trim would be needed to fill the gap, the frame can be manufactured in custom thickness' dictated by its application.

Another integral component of the present invention is the T-bar which is substantially defined as having a depth equal to the depth of the window/door frame, the number of tracks being of equal number to the frame tracks and in alignment therewith. Also having accessible concealed tracks on each side. The fascia is approximately twice the width of the frame width whereby two juxtapositioned window types would appear to be in their own window frames. The fascia is offset from each distal end the height of the window/door lip whereby when placed within a frame the fascia of the t-bar and frame are in planar alignment. Basically, the t-bar is back to back frame sections.

Another integral part of the present invention is the window/door sash which is used as the retaining member for the glass panels, glazing beads, and/or weather stripping which may require channeling the part to mate the stripping to the sash. The sash is substantially h-shaped. The base of the shape is designed to slide along a track member, mate with stops to seal a moveable window/door member to the frame or t-bar in the closed position or the sash may not be used at all if the unit is a directset picture or jalousie windows.

The frame insert is another integral component of the present invention. The frame insert may be placed into a predetermined channel in the frame and or t-bar member and act as a track guide or stop in cooperation with the window/door sash. It should be noted that additionally by routing a channel in the upper surface and placing a spring within the base the frame insert can function as the guide for single, double and triple hung windows.

2. Description of the Prior Art

There are other window assemblies designed for modularity. Typical of these is U.S. Pat. No. 2,834,071 issued to Camerino on May 13, 1958.

Another patent was issued to Anderson on Jun. 14, 1977 as U.S. Pat. No. 4,028,849. Yet another U.S. Pat. No. 4,158,934 was issued to Olsen on Jun. 26, 1979 and still yet another was issued on Mar. 18, 1980 to Molyneux as U.S. Pat. No. 4,193,231.

Another patent was issued to Tanaka et al on Apr. 26, 1988 as U.S. Pat. No. 4,740,405. Yet another U.S. Pat. No. 4,856,239 was issued to Elsasser on Aug. 15, 1989. Another was issued to Fast et al. on Feb. 25, 1992 as U.S. Pat. No. 5,090,168 and still yet another was issued on Sep. 17, 1996 to Colitto as U.S. Pat. No. 5,555,682.

Another patent was issued to Bruchu on Nov. 18, 1997 as U.S. Pat. No. 5,687,519. Yet another U.S. Pat. No. 5,692,349 was issued to Guillemet on Dec. 2, 1997. Another was issued to Suess on Sep. 19, 2000 as U.S. Pat. No. 6,119,324 and still yet another was issued on Dec. 18, 2001 to Manzella as U.S. Pat. No. 6,330,769.

The invention is an auxiliary window unit formed to fit in window openings of varying sizes and to be mounted to conventional stops about the inner walls of the window opening, comprising a rectangular casing adapted to receive sash members therein, a pair or perimetrical closely spaced flanges extending integrally from the outer walls of the casing and defining between them a continuous narrow channel about the casing, resilient material lining the inner walls of the channel, four broad flat strips defining a rectangular outer frame for the casing, two of the strips being in opposed relation and having their marginal end portions recessed in from their inner edges, the other two strips having offset marginal end portions overlapping the aforementioned recessed marginal end portions, each strip normally extending part way into the channel between the resilient lining and being frictionally gripped by the latter, and each strip being movable as desired further in or out of the channel whereby the overall projected dimensions of the combined casing and outer frame may be selectively expanded or contracted so as to fit in a selected window opening, whereby the casing attains a floating relation to the fixed outer frame by virtue of the resiliently lined channel in which the outer frame is gripped.

Universal window structure for use as a single-hung window, a hopper window, or a right or left-hand glider window and having a box frame and at least one movable sash is disclosed. An improved mull cover for securing a plurality of the universal window structures together, sash guide and tilt release structure for permitting tilting of the movable sash out of the plane of the window structure, and sash guide and pivot structure for the movable sash are also disclosed, together with an improved sash balance shoe, improved locking structure for the movable sash, improved glazing structure, improved weather stripping, structure for maintaining the weathertightness of the window structure during high winds, and a combination screen retainer and movable sash seal. The window structure of the invention may be installed from the inside of a window opening by means of unique installation clips and can be installed from the exterior of a window opening in conjunction with a unique installation bracket. Trim extensions are also provided with the window structure for finishing a window opening in which the window structure is installed. The window structure of the invention has provision for weepage installed as a single-hung hopper or as a right or left-hand glider window. The movable sash of the window structure of the invention is separated from the frame thereof and guiding and spacing means to eliminate metal-to-metal engagement between the movable sash and the window frame are provided whereby the window structure is particularly quiet in operation.

A window sash construction is disclosed for wood framed windows in which a particular stile-rail and check rail member configuration is utilized to adapt a given sash to both vertical double hung and horizontal sliding installations, each sash unit being constructed with a common stile and rail sectional configuration such that all stile and rail members may be provided by two sash member types differing only in having two different end configurations and a common check rail shape in order to assemble the universal sash units. A reversible common check rail configuration is also provided such that the sash units can be oriented in any mating arrangement while obtaining a proper seal. An antijam check rail seal installation is incorporated in one of the check rail surfaces in engagement when the window is closed, including a seal recess configured to allow an outwardly biased seal lip to cam itself back out of the unoccupied seal recess formed in the mating check rail surface in the event the check rails are displaced beyond their normal engaging position sufficiently for the seal to enter the opposing recess position.

The invention provides a structural assembly for use in a building comprising an elongate structural element for use in a frame (such as a window or door frame) in an opening in the wall of the building, said structural element providing an effective pocket open along one side thereof, and a sill which comprises an elongate plate-like element formed along its inner edge with an arcuate surface as seen in transverse section, whereby said sill is adapted for rocking motion about its inner edge, said inner edge of said sill being received within said pocket and said plate-like element extending laterally from said elongate structural element. The invention also provides a sill for use in the structural assembly, wherein the inner edge of the sill is formed into a part cylindrical scroll, and wherein the outer edge is formed with a drip bead which as seen in transverse section has an arcuate surface facing inwardly, for engagement with the outer face of a wall of the building adjacent to an opening in which the sill is used.

An extruded frame member includes an elongated molded body of a one-piece construction having at least one elongated sheet-like wall having at least one elongated projection formed on one side of the wall and extending longitudinally of the molded body. A reinforcing wire is embedded in and extends along the elongated projection. The molded body is made of a thermoplastic resin. The reinforcing wire includes a bundle of fibers joined together by a thermosetting resin impregnated in the fiber bundle. The fibers have a higher melting point than the thermoplastic resin.

A window frame member formed as a hollow extrusion of rigid plastics material has a hollow space partly defined by a wall portion including two opposed, undercut lips and a web interconnecting the lips. Internal grooves are provided along the junctions of the web with the lips to provide lines of severance allowing the web to be readily removed so as to provide a slot between the edges of the lips. Preferably, the web and adjoining parts of the lips have a smooth, uninterrupted exterior surface. This invention allows the frame member to be used either with the web in place, in which case there is no slot or observable discontinuity in the exterior wall, or with the web removed where it is desired to provide a slot for weather stripping or attachment of adjacent pieces. The web may be readily removed with simple tools.

A window frame system includes four basic profiles for new building construction and for various other projects including renovation, bow and bay constructions. One profile includes an outer profile for engagement with the wall of a new building in which the distance between the inside wall of the profile and a nailing fin is at least 6.5 inches. The height of the profile is then reduced to accommodate this larger width. A cross mullion is provided and a sash frame profile is also provided. The inner wall of the outer frame and the side walls of the mullion are arranged for cooperation either with a picture window unit or with the sash frame. The fourth profile comprises a renovation/bow profile which can be inserted into an existing window frame or can be snapped together alongside similar profiles to form a bow or bay construction.

A vinyl window frame has an accessory groove which is covered by a removable strip. When the groove is uncovered, it opens at an exposed face of the window frame. The frame includes first and second regions of weakness which facilitate removal of the strip. The first region of weakness is provided at the inside surface without penetrating through to the outside surface of the strip and the second region of weakness is provided along a side edge of the frame such that neither region of weakness is visible at the exposed face of the window frame.

A universal frame renders a double hung pocket replacement window suitable for window out—window in replacement and/or new construction installation, and likewise, renders a casement pocket replacement window suitable for window out—window in replacement and/or new construction installation, and likewise, renders a picture pocket replacement window suitable for window out—window in replacement and/or new construction installation, and likewise, renders a glider pocket replacement window suitable for window out—window in replacement and/or new construction installation, thereby giving rise to economies of scale in the manufacturing and distributing processes for a variety of windows.

A frame made of moldable material is described for retaining a closure member, such as a window, in a door or wall opening. The frame is formed by interconnecting a peripheral main frame member, an outer peripheral casing connecting molding and inner peripheral sash connecting molding. The main frame member has an outer sash section, a side jamb section and an inner casing section. The outer casing connecting molding is adapted to be snappingly secured to the main frame member to clampingly retain the main frame member to a frame forming the opening. The inner sash connecting molding is adapted to be snappingly secured to the main frame member and has a bridge wall section to abut against a peripheral section of the closure member to retain it captive between the outer sash section and the inner sash connecting molding.

An apparatus and process for forming a discontinuous slot, recess or other such opening of predetermined size and location in an extrusion section, such as a window jamb liner. The apparatus includes a cutting or shaping device mounted on or closely adjacent an extruding die, such device including a tip movable between a retracted position and an extended position. In the extended position, the tip engages the extrusion as the extrusion is formed and leaves the die, to thereby slit or otherwise remove a strip or other predetermined amount of material from the extrusion and thus form a recess or opening. As the cutter-like member is extended into or retracted from the extrusion, the tip of the cutter-like member shears the extrusion cross-wise to form an opening which may form an end of a slot and the length of time the tip remains in such contact with the extrusion determines the slots length. An extruded window jamb liner manufactured by the apparatus and process is also provided, the jamb liner including at least one discontinuous opening of predetermined length and location.

A frame including a bracket receiver structure and at least one frame-to-sash bracket removably secured to the bracket receiver structure such that the frame-to-sash bracket can be removed or repositioned to enable various sash types to be interchanged within the frame. The frame-to-sash bracket can be a bracket configured to mount a double-hung sash, an inswing sash or an outswing sash within the frame. The various sash types can be installed from either the exterior side or the interior side of the frame.

While these window assemblies may be suitable for the purposes for which they were designed, they would not be as suitable for the purposes of the present invention, as hereinafter described.

SUMMARY OF THE PRESENT INVENTION

A primary object of the present invention is to provide universal window elements that can be used to create a plurality of window/door types.

Another object of the present invention is to provide universal window elements having a common glass line.

Yet another object of the present invention is to provide a plurality of window/door types having a common glass line.

Still yet another object of the present invention is to provide universal window elements that can be combined to form various window type with a single frame.

Another object of the present invention is to provide universal window elements whereby various types of windows when combined within a single frame have a common vertical and/or horizontal glass line.

Yet another object of the present invention is to provide universal window elements whereby various window/door type are connected by a T-bar.

Still yet another object of the present invention is to provide universal window elements having a frame with concealed channels whereby window type can be selectively positioned interiorly or exteriorly.

Additional objects of the present invention will appear as the description proceeds.

The present invention overcomes the shortcomings of the prior art by providing a universal window/door frame comprised of a group of components that can be used singularly or in combination to form a plurality of window/door types having one or more elements comprised of a frame, sash, t-bar and/or frame insert.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

LIST OF REFERENCE NUMERALS UTILIZED IN THE DRAWINGS

10 window/door assemblage
12 frame member
14 frame member flange
16 frame member top wall
18 frame member bottom wall
20 frame member channels
22 frame member first distal end
24 frame member second distal end
26 frame member channel cover
28 frame member channel base
30 frame member channel first wall
32 frame member channel second wall
34 frame member flange interior wall
36 frame member flange top surface
38 frame member flange exterior wall
40 frame member flange first distal end
42 frame member flange second distal end
44 frame member interior groove
46 frame member exterior groove
48 integral support structure
50 T-bar member
52 T-bar member flange
54 T-bar member top wall
56 T-bar member bottom wall
58 T-bar member first distal end
60 T-bar member second distal end
62 T-bar member flange first frame mating offset
64 T-bar member flange second mating offset
66 T-bar member flange first interior wall
68 T-bar member flange second interior wall
70 T-bar member flange top surface
72 T-bar member flange exterior wall
74 T-bar member flange first distal end
76 T-bar member flange second distal end
78 sash member
80 sash first wall
82 sash second wall
84 sash first distal end
86 sash second distal end
88 sash top surface
90 sash glass stop
92 sash bottom surface
94 sash channel
96 sash channel top surface

98 sash channel first wall
100 sash channel second wall
102 sash window/door support surface
104 sash glazing retaining groove
106 sash cavity
108 frame insert
110 frame insert upper first wall
112 frame insert upper second wall
114 frame insert lower first wall
116 frame insert lower second wall
118 frame insert top surface
120 frame insert ledge
122 frame insert first distal end
124 frame insert second distal end
126 frame insert channel
128 frame insert channel top surface
130 frame insert channel first wall
132 frame insert channel second wall
134 frame insert bottom insert
136 double slider window
138 horizontal pivoting window
140 triple hung window
142 double slider patio door
144 casement window
145 picture window
146 single slider window
148 jalousie window
150 single sash window
152 hinged patio door
154 bottom hinged hopper
156 fuzzy weather strip
158 screen spline acceptor
160 tape
162 glass
163 screen
164 glazing bead
166 cord
168 coil or spring
170 cut out
172 weather strip channel
174 counterweight hardware
176 frame and sash thickness
178 glass line
180 shutters

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT the following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
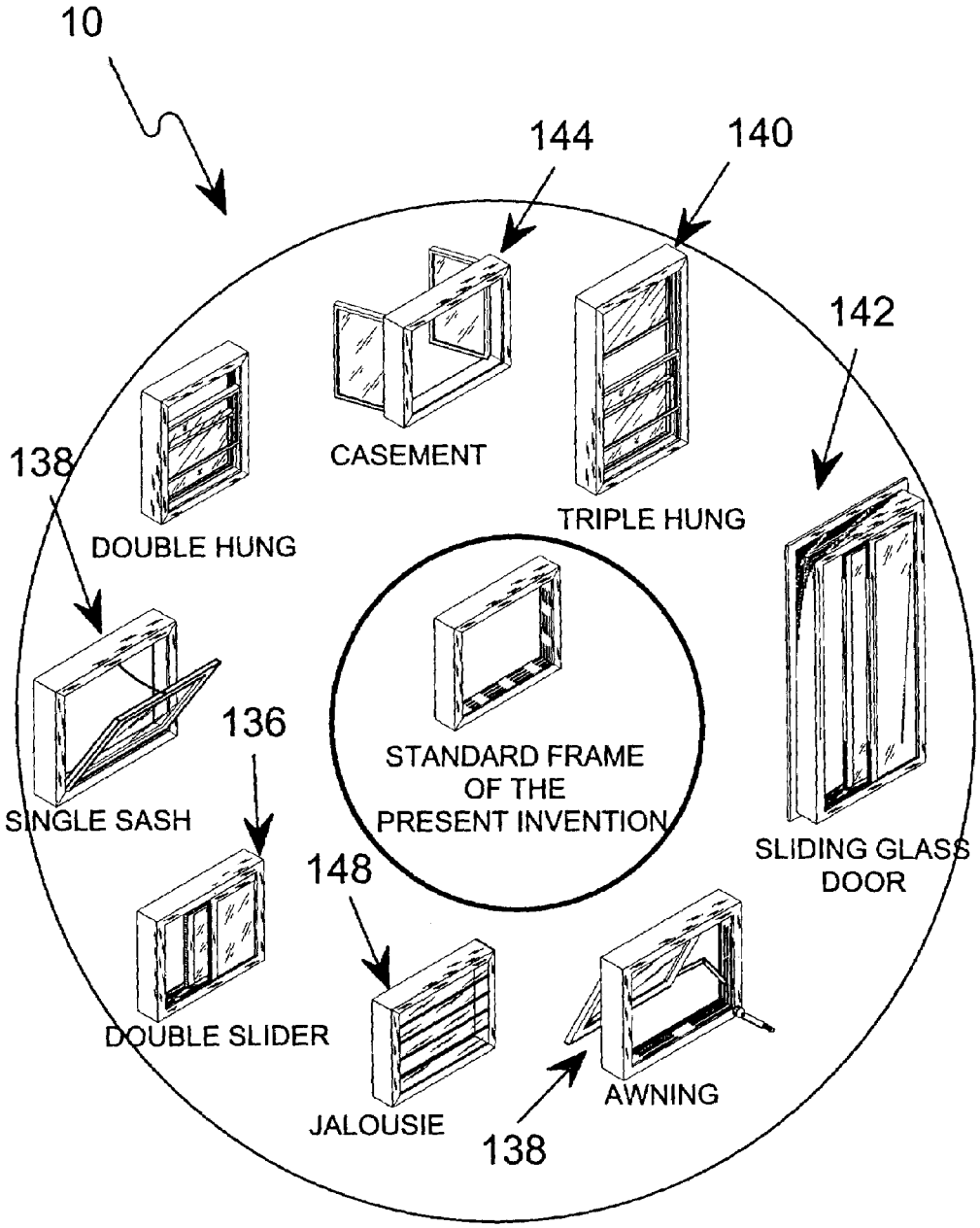
FIG. 1 is an illustrative view of the uses of the present invention.

FIG. 1 is an illustrative view of the uses of the present invention The present invention is a group of components that can be combined to form various window and door types having a common glass line regardless of the type of window or door design. This is accomplished by having a frame, sash and t-bar of standard thickness that forms the frame and glass holding elements of the window or door.

Most ancillary hardware defining the window type uses one or more of a plurality of concealed channels contained within the frame. When necessary, access to and use of the channels is obtained by removing material forming the interior wall of the frame providing access to the concealed channel or channels that will be used to define the windows functional components, such as having a screen or a sliding member. Some types, i.e. jalousie and direct set picture windows, do not require the use of the concealed channels.

Figure 2:
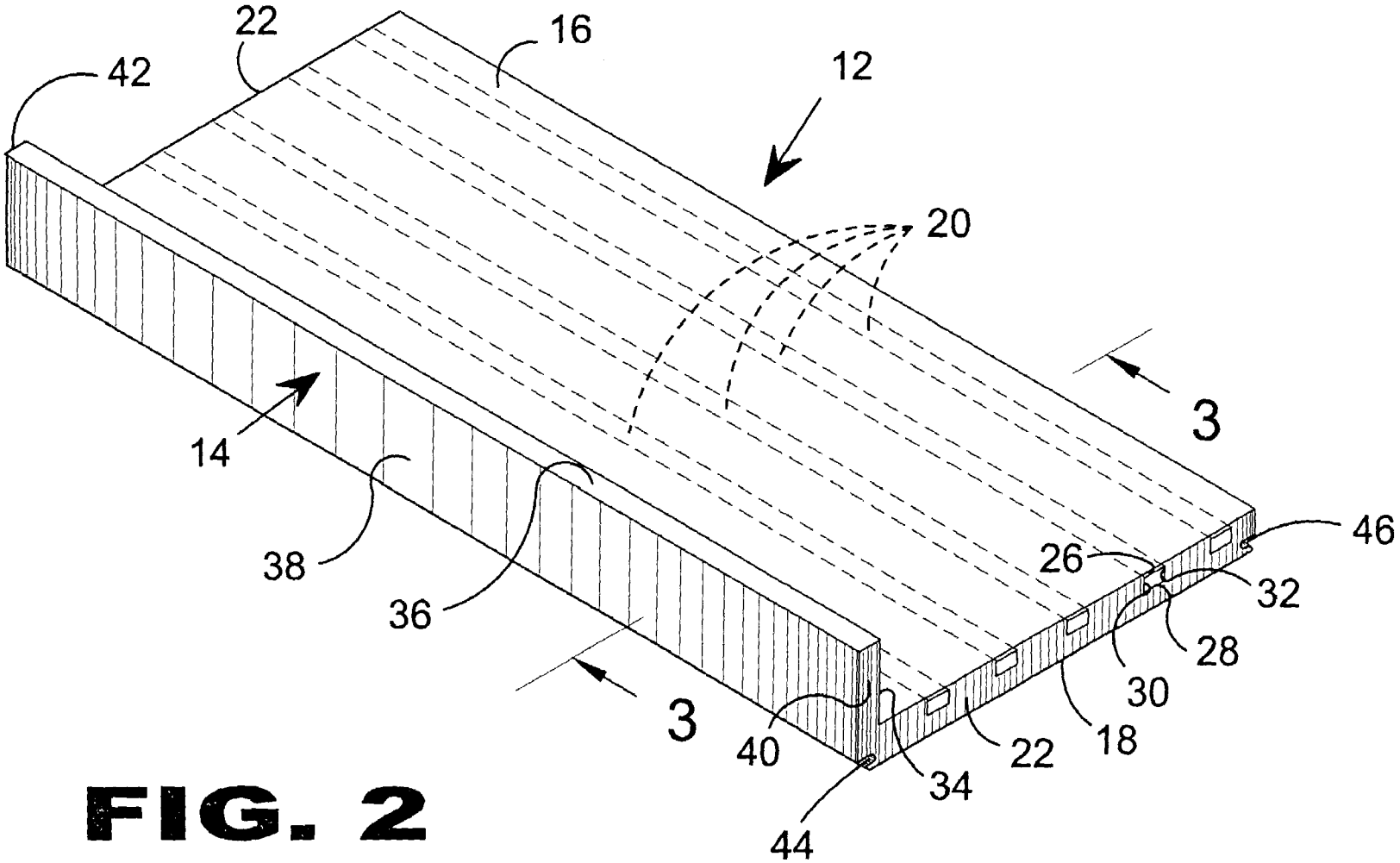
FIG. 2 is a perspective view of a section of frame of the present invention.

Referring to FIG. 2, shown is the frame member 12 of the present invention. The frame member has a top wall 16 and spaced apart bottom wall 18 with an interior structural framework that is appropriate for the application of the frame. Also concealed between the spaced apart walls 16, 18 are a plurality of channels 20 forming a throughbore in frame member 12 extending between the first distal end 22 and second distal end 24 having a base 28 and spaced apart walls 30, 32 that can be used by removing, such as by cutting, the covering material 26. The frame member 12 also has an integral flange 14 extending perpendicularly from top wall 16 having an interior flange wall 34, exterior flange wall 38 and top surface 36. The flange first distal end 40 and second distal end 42 are essentially equivalent in length to the distance between the frame first distal end 22 and second distal end 24. Also shown is interior groove 44 and exterior groove 46 that can be used as mating slots for weatherstripping.

The channels 20 are exposed and used as needed by the particular window type. A sliding glass window may use one channel. The addition of a sliding screen member would use an additional channel. No channel is used in certain instances such as a picture window or a jalousie window. The plurality of channels also provides for selective placement of the window members. A double hung window could be positioned to the interior or the exterior of the frame to accommodate additional components or to achieve a particular design effect. It should also be noted that while the preferred embodiment would have a depth substantially equal to the normal wall construction width of an interior and exterior wall covering spaced by a 2×4 thereby no interior or exterior trim would be needed to fill the gap, the frame 12 can be manufactured in custom thicknesses dictated by its application.

Figure 3:
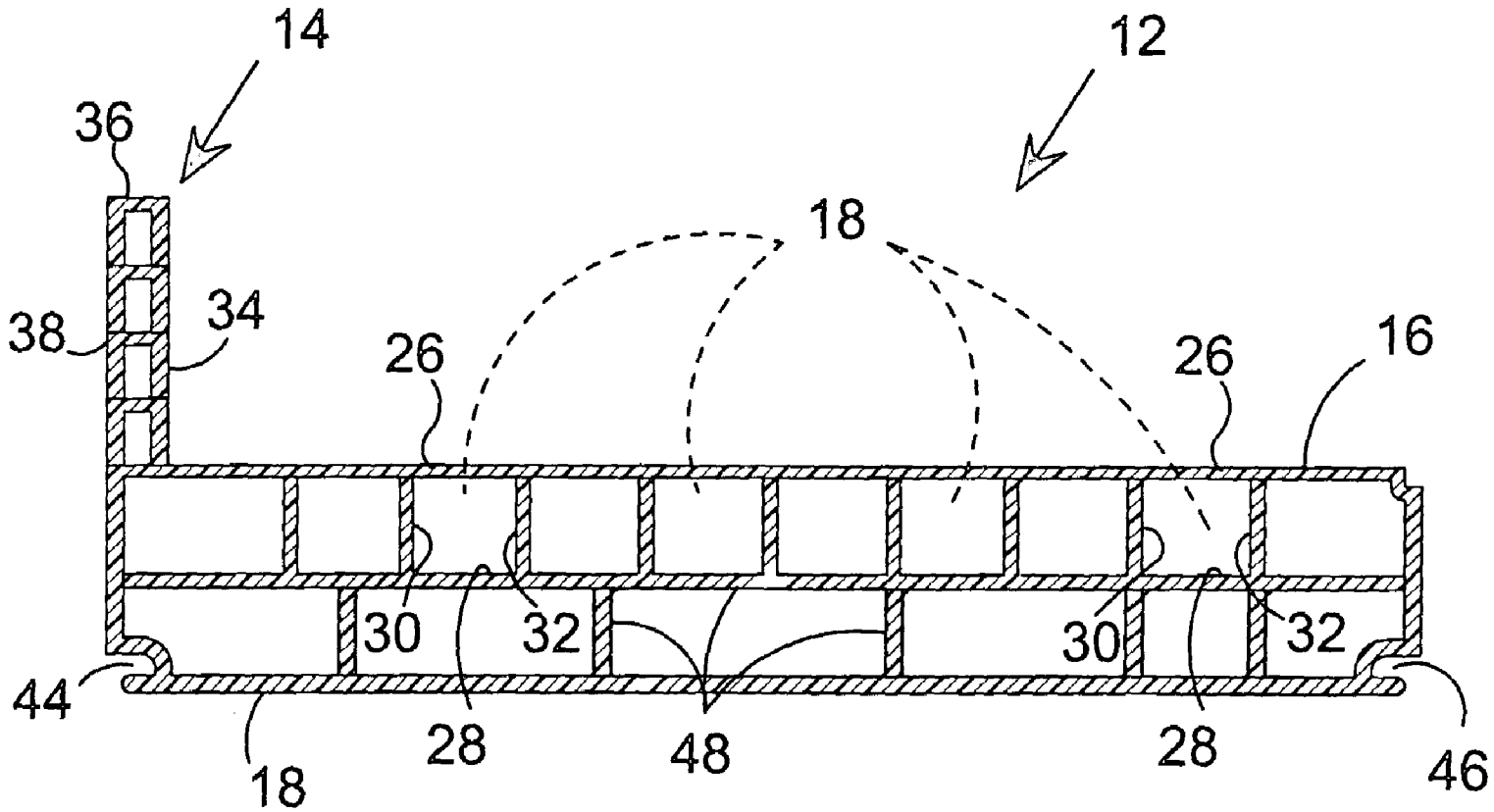
FIG. 3 is cross sectional side view of the window/door frame of the present invention.

Referring to FIG. 3, shown is a cross sectional side view of the window/door frame 12 of the present invention, taken from FIG. 2 as indicated. Illustrated is a typical frame member l2 having a plurality of parallel channels 20. The frame member has a top wall 16 and bottom wall 18 with an interior structural framework 48 that is designed for the application of the frame. Each of the channels 20 forms a throughbore in frame 12 having a base 28, a channel first wall 30 and channel second wall 32 that are accessed through the removal of covering material 26. The frame 12 also has an integral flange 14 having an interior flange wall 34, exterior flange wall 38 and top surface 36. The frame also has interior groove 44 and exterior groove 46 that can be used for items well known within the art, like weatherstripping.

The plurality of channels 20 provides for the selective placement of one or more sashes and/or frame inserts. An example, a window member can be placed on an interior channel or an exterior channel. In the northern United States winter condensation is a problem resulting in damage to window sills and walls from the condensation runoff. By placing the window members back one or more channels, the frame provides a trough for the condensation runoff. Additionally movement of the window members can be performed to accommodate interior or exterior shutters, blinds or rollup screen. The ability to selectively place a widow member on the frame either interiorly or exteriorly is unavailable in the prior art. Furthermore the mating of one window type to another such as a double hung to a triple hung, which has an additional thickness, can be accommodated by moving the placement either interiorly or exteriorly allowing for the selective planar alignment of the interior or exterior members. The possibilities of mating one window/door type to another is only limited by the creativity of the designer.

Figure 4:
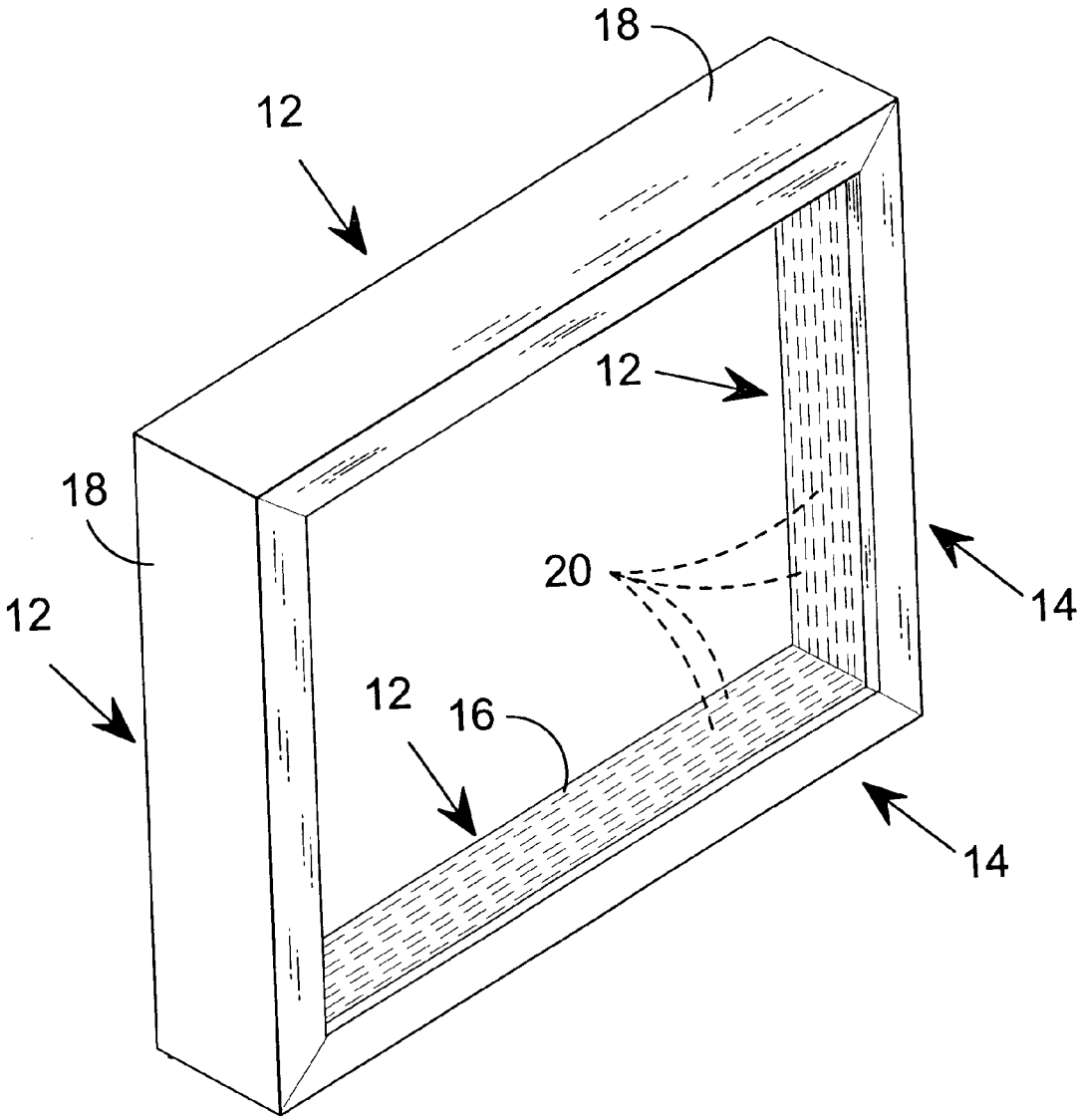
FIG. 4 is a perspective view of the frame of the present invention assembled.

Referring to FIG. 4, shown are lengths of frame member 12 bonded by means well known within the art to form a frame for a single window or door type. The frame member has a plurality of channels 20 that are concealed and can be accessed by removing the covering material 26 as need, if at all. The concealed channels 20 are in alignment from one frame member 12 to the adjacent frame member 12. Thereby a channel can be exposed entirely around the interior periphery, opposing sides can be exposed or a single side can have the covering material 26 removed. The window/door frame formed of lengths of frame 12 can be inserted into a rough opening wherein the frame wall 18 would engage the rough opening while the frame interior wall 16 engages the material used for the window or door. The frame flange 14 extends around the interior and forms a glass line that would be consistent from one window type to the next. The glass line is the viewable area not obstructed by the frame or any of its components.

Depending on the type of window/door being assembled one or more or none of the channels 20 will have the interior channel cover 26 removed for the placement therein of the necessary components defining the window/door. A picture window wouldn't require any modification to the frame, a double hung or triple hung window would require a number of vertical sashes as guides while a sliding window may have one or more tracks and stops. The juxtaposition of one window type to another may dictate the need for one or more t-bars.

Figure 5:
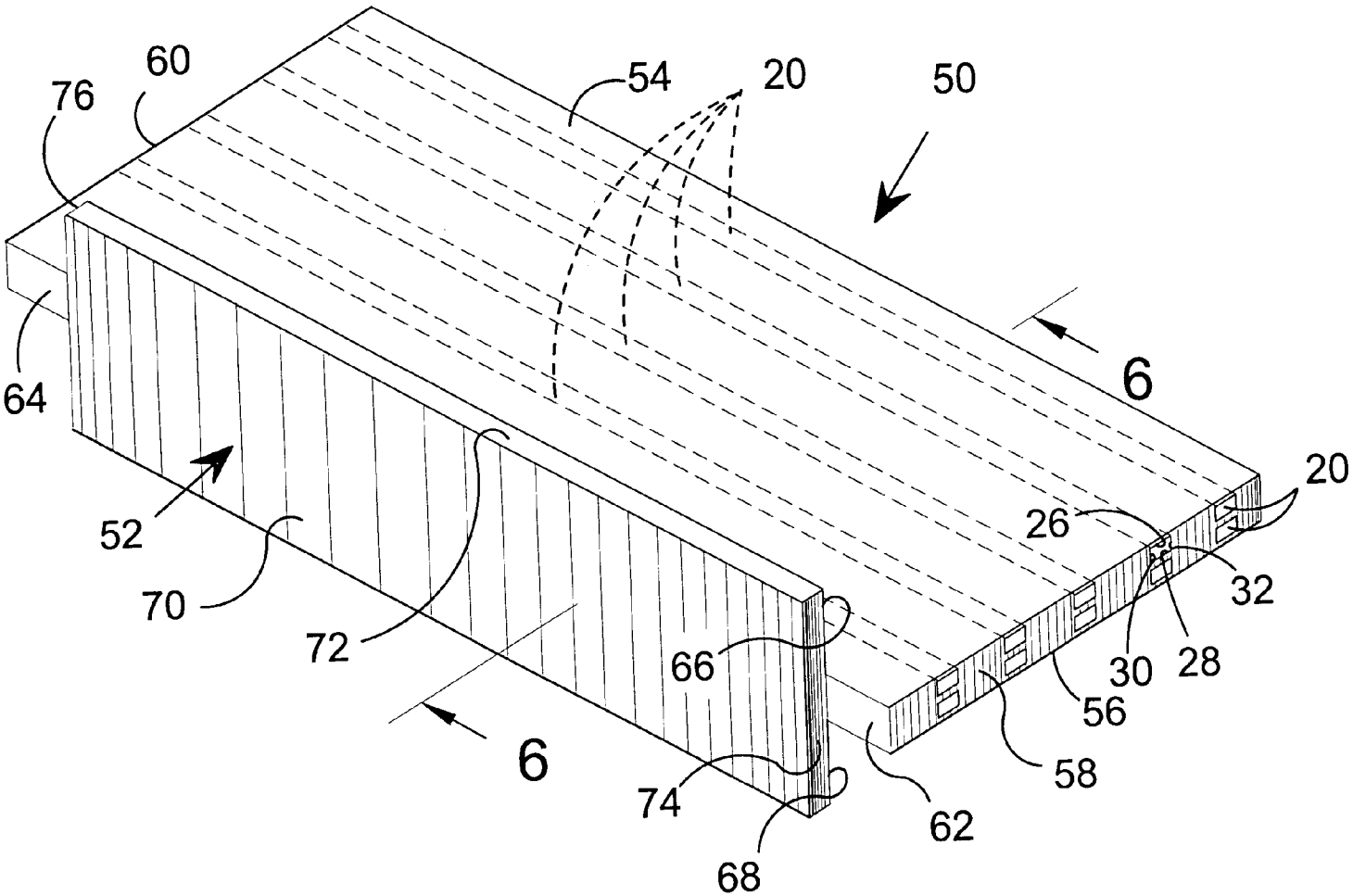
FIG. 5 is a perspective view of a t-bar of the present invention.

Referring to FIG. 5, shown is the T-bar member 50 of the present invention. The T-bar member has an top wall 54 and bottom wall 56 with two rows of concealed channels 20 forming a throughbore in T-bar member 50 extending between the first distal end 58 and second distal end 60 having a base 28 and spaced apart walls 30, 32 that can be used by removing the covering material 26. The T-bar member 50 also has an integral flange 52 extending perpendicularly from the top wall 54 and bottom wall 56 having an interior bottom flange wall 66, top flange wall 68, exterior flange wall 70 and top surface 72. Because the T-bar is used to join window/door type with a single exterior frame, the T-bar flange is approximately twice the width of the frame flange 14. T-bar first interior wall 66 and second interior wall 68 are substantially equal height as the frame member flange interior wall 34. Also there are two rows of concealed channels 20 since one side of the T-bar is for one window/door type while the other side is for another window/door type. The window/door types can be dissimilar types. Furthermore, the distance between the T-bar flange first distal end 74 and second flange distal end 76 is not equivalent in length to the distance between the T-bar first distal end 58 and second distal end 60 allowing for a portion of the T-bar, first flange offset 62 and T-bar second flange offset 64 to engage opposing frame member interior walls 34. T-bar flange distal ends 74, 76 once installed will be flush with frame member flange top surface 36.

The T-bar fascia is approximately twice the width of the frame width so that two juxtapositioned window types would appear to be in their own window frames. The fascia is offset from each distal end the height of the window/door lip whereby when placed within a frame the fascia of the t-bar and frame are in planar alignment. Basically, the t-bar is back to back frame sections.

Figure 6:
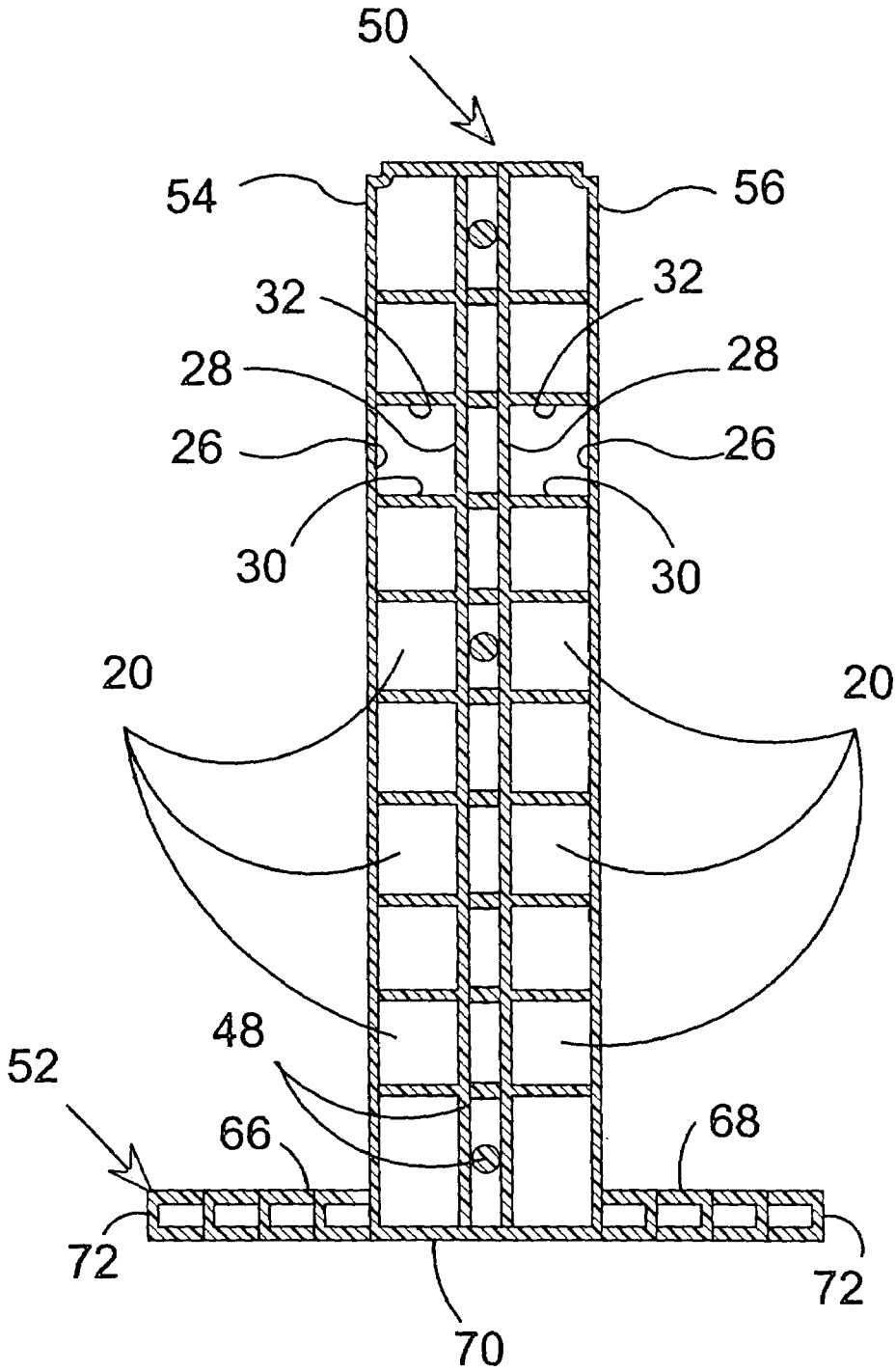
FIG. 6 is cross sectional view of a universal t-bar.

Referring to FIG. 6, shown is a cross sectional view of the T-bar member 50 of the present invention, taken from FIG. 5 as indicated. Illustrated is a typical T-bar member 50 having a plurality of opposing parallel channels 20 that will mate with frame member channels 20 when the window/door is assembled. The T-bar member has a first wall 54 and second wall 56 with an interior structural framework 48 that is designed for the application of the T-bar. Each of the opposing channels 20 forms a throughbore in T-bar 50 having a base 28, a channel first wall 30 and channel second wall 32 that are accessed through the removal of covering material 26. The T-bar flange 52 runs longitudinally perpendicular to the T-bar member 50 having a T-bar flange first interior wall 66 and a T-bar second interior wall 68. Each of which is of substantially equal height as the frame member interior wall 34 so that the glass line around the frame and T-bar members is approximately equal. The T-bar flange exterior wall 72 mates with the frame member flange top surface 36 thereby T-bar flange top surface 70 and frame member flange exterior wall 38 are co-planar.

The term universal T-bar applies to the fact that the T-bar can be positioned between various window types eliminating the need to join one window frame to another. Its distal ends can be joined to opposing frame sides or to another T-bar. The ability to use a T-bar between different window types is unavailable in the prior art. Also unavailable in the prior art is a T-bar that can be selectively placed as the window/door design dictates since the channel alignment between frame and T-bar is consistent. It should also be noted that since a T-bar can be used to join one window type to another instead of a window frame to a window frame, the structural integrity of a multi-window design is more substantial and eliminates potential spaces between window type where drafts can occur.

Figure 7:
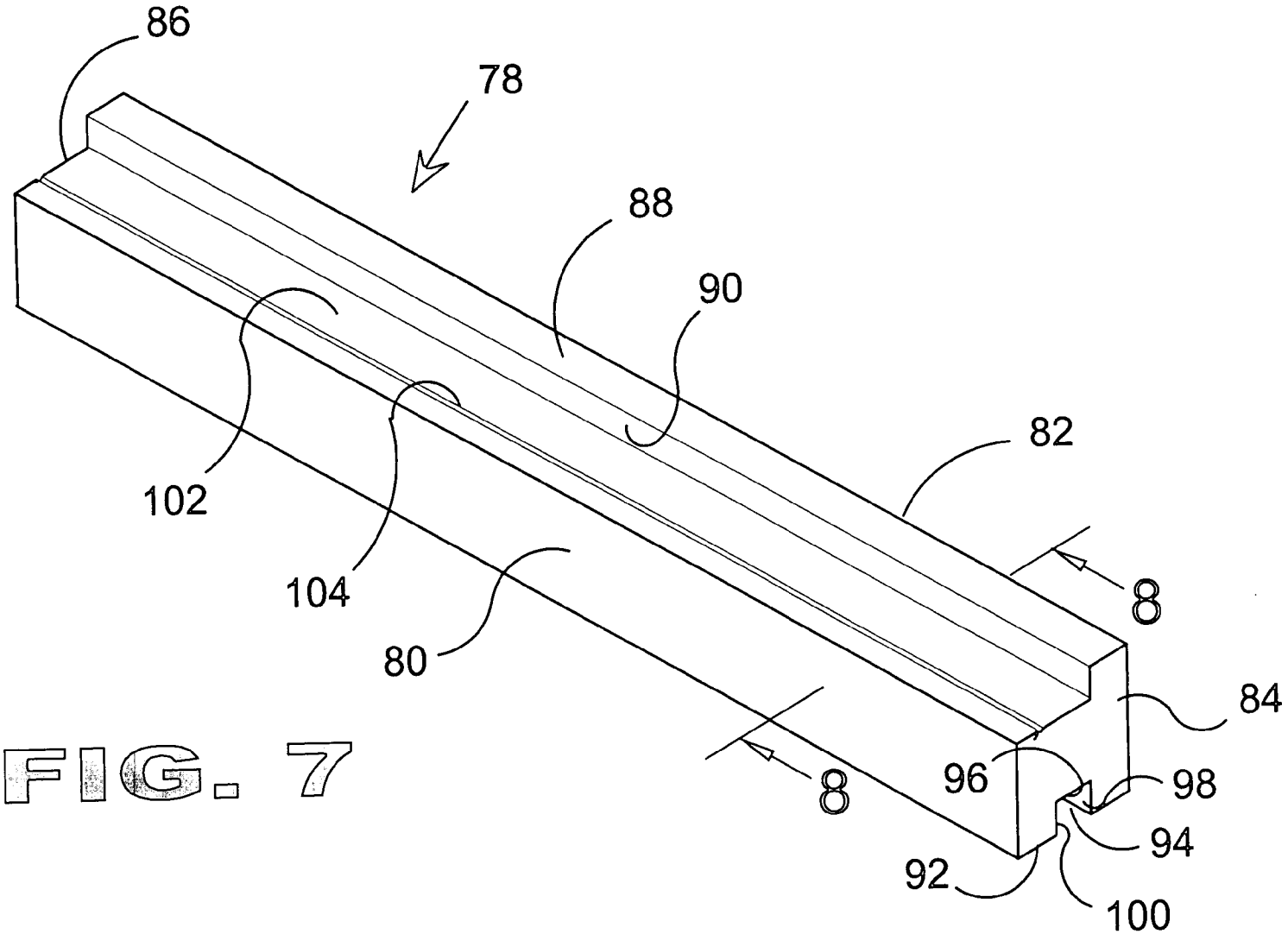
FIG. 7 is a perspective view of the window/door sash

Referring to FIG. 7, shown in the sash member 78 of the present invention. The sash member 78 has a first wall 80, a second wall 82, a first distal end 84 and a second distal end 86 which define the support member for the glass of the window/door. The material support surface of the sash has a sash top surface 88 and sash glass top 90 that forms the interior retaining member for the glass. The exterior retaining member is a sash glazing retaining groove 104 positioned within the sash window/door support surface 102. Also shown is the sash channel 94 that travels from the sash first distal end 84 to the second distal end 86. The sash channel is comprised of a channel top surface 96, channel first wall 98 and channel second wall 100.

The window/door sash is used as the retaining member for the glass panels, glazing beads, and/or weather stripping which may require channeling the part to mate the stripping to the sash. The sash is substantially H-shaped. The base of the shape is designed to slide along a track member, mate with stops to seal a moveable window/door member to the frame or T-bar in the closed position or the sash may not be used at all if the unit is a directset picture or jalousie windows.

Figure 8:
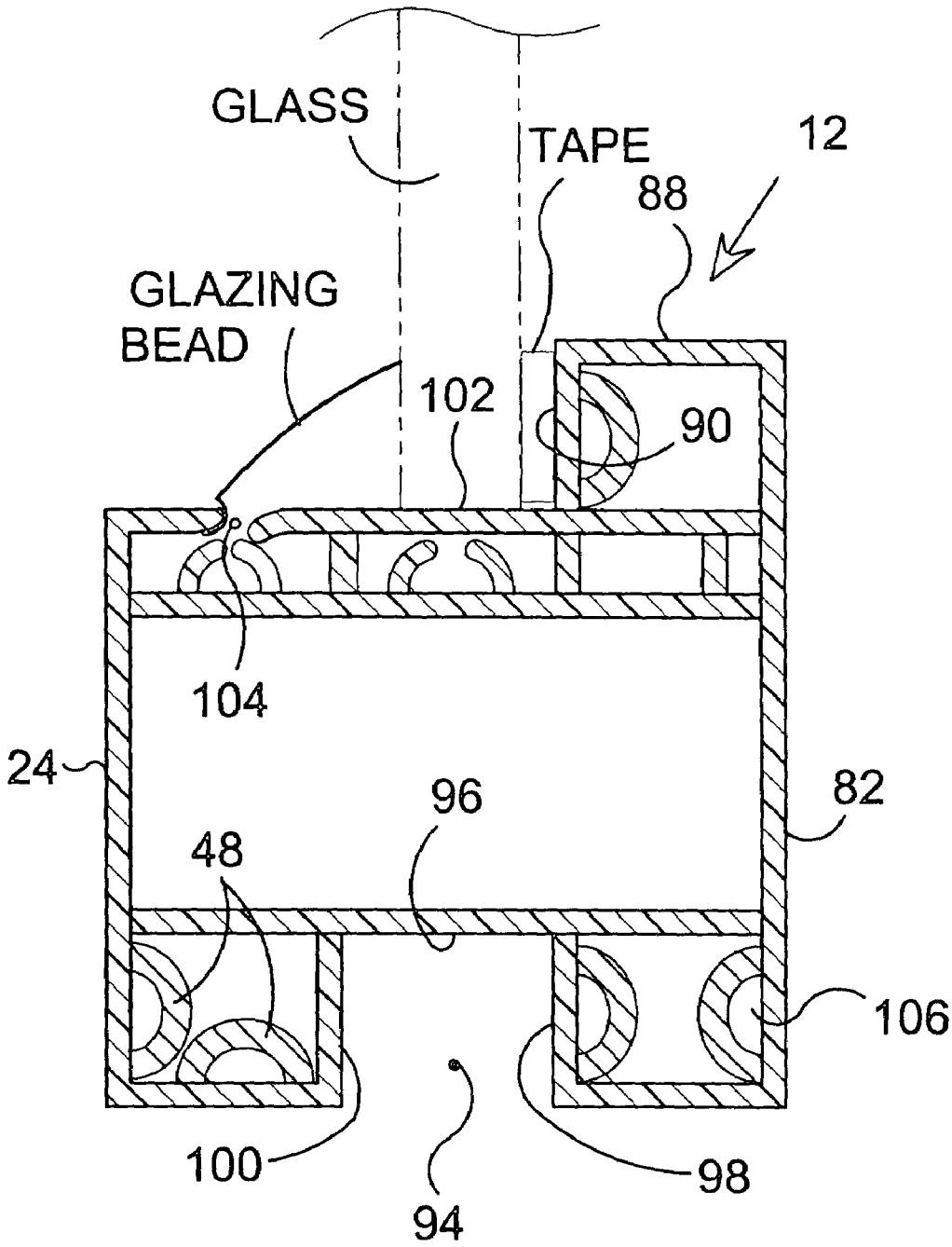
FIG. 8 is a sectional view of the window/door sash.

Referring to FIG. 8, shown is a cross sectional view of the sash taken from FIG. 7 as indicated. For illustrative purpose only glass, tape and glazing bead are shown to demonstrate the mounting of the glass to the sash. The sash 78 is substantially h-shaped having spaced apart first wall 80 and second wall 82 with structural support 48 which may be manufactured to serve a dual purpose as shown by cavity 106. Further machining to create a slot providing access to cavity 106 would provide means for anchoring weatherstripping therein. As seen in the illustration there are a number of such cavities that add functionality to the sash 78 that can be utilized during assemblage or during installation. The sash design anticipates a plurality of additional elements that can be used to enhance the capabilities of the sash 78. Additionally shown is the sash support surface 102 that functions as the means for holding the glass in a semi-permanent position between the glass stop 90 and glazing retaining groove 104. The sash also has a channel 94 that extends the length of the sash 78. The sash channel is comprised of a top surface 96, channel first wall 98 and channel second wall 100. The sash channel is design to mate with or hold other predetermined elements for a window type.

The sash has a central channel extending longitudinally that may encompass a track guide, hardware and/or stop. It is primarily used to retain a glass pane against the sash glass stop by means well known within the art. The half donut shaped structures forming the integral support structure can be accesses providing placement of weather strips, screen, screen spline or more depending on function of the sash within a particular window type. The added thicknesses of the frame and sash members would be consistent across the window and door types thereby providing the capability of mixing window and door types having a common glass line from one window/door to the next.

Figure 9:
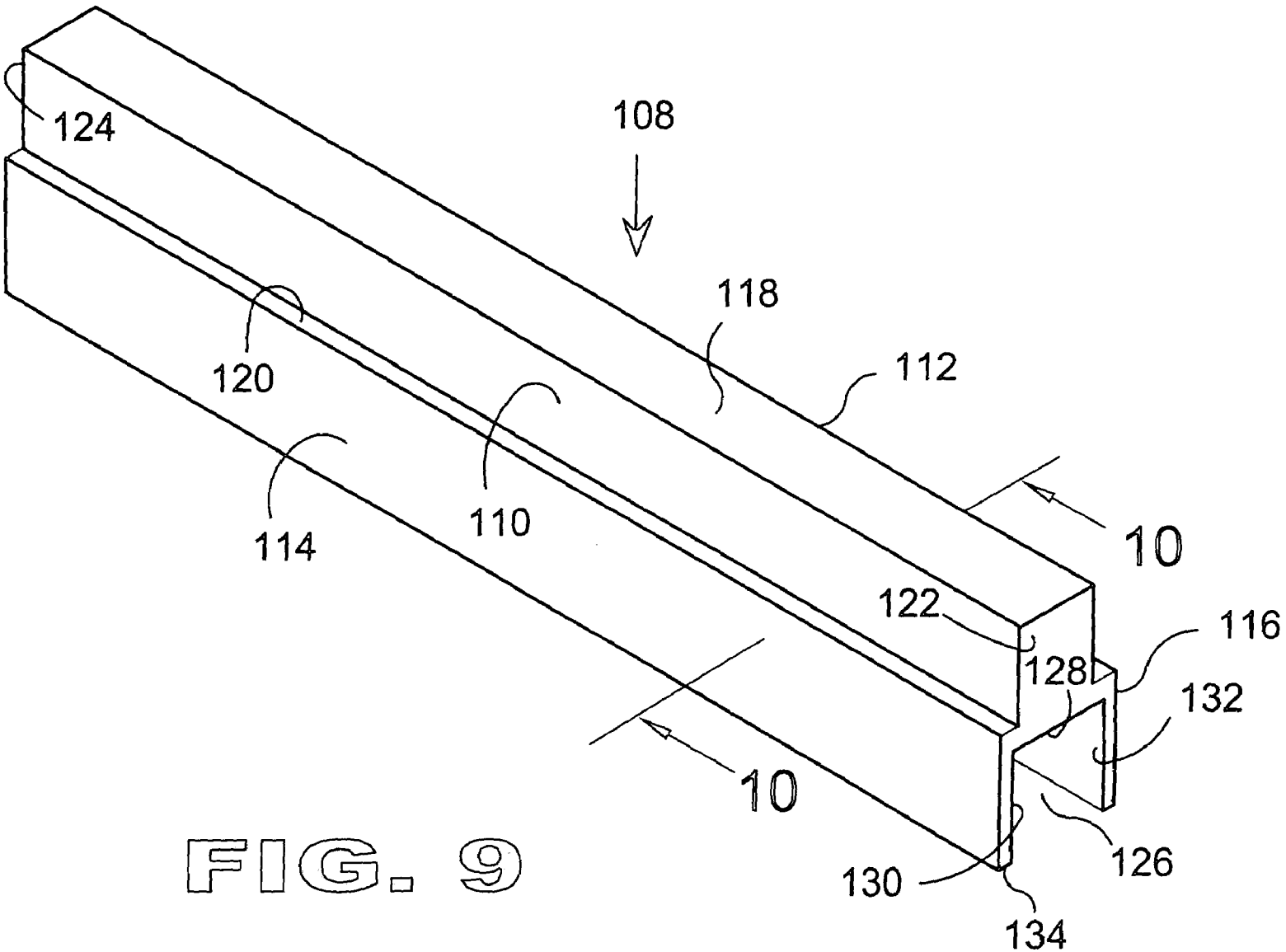
FIG. 9 is a perspective view of the frame insert.

Referring to FIG. 9, shown is the frame insert of the present invention. The frame insert 108 is comprised of a frame insert upper first wall 110, upper second wall 112, and top surface 118 that form a track guide or stop depending on the window/door type that it is placed in. The frame insert also has a lower first wall 114, lower second wall 116 being spaced away from the upper walls by the frame insert ledge 120. The lower walls house the frame insert channel 126 having a top surface 128, channel first wall 130 and channel second wall 134. The channel 126 extends from the frame insert first distal end 122 to the frame insert second distal end 124.

The frame insert is another integral component of the present invention. The frame insert may be placed into a predetermined channel in the frame and or T-bar and act as a track guide or stop in cooperation with the window/door sash. It should be noted that additionally by routing a channel in the upper surface and placing a spring within the frame insert channel the frame insert can function as the guide for single, double and triple hung windows.

Figure 10:
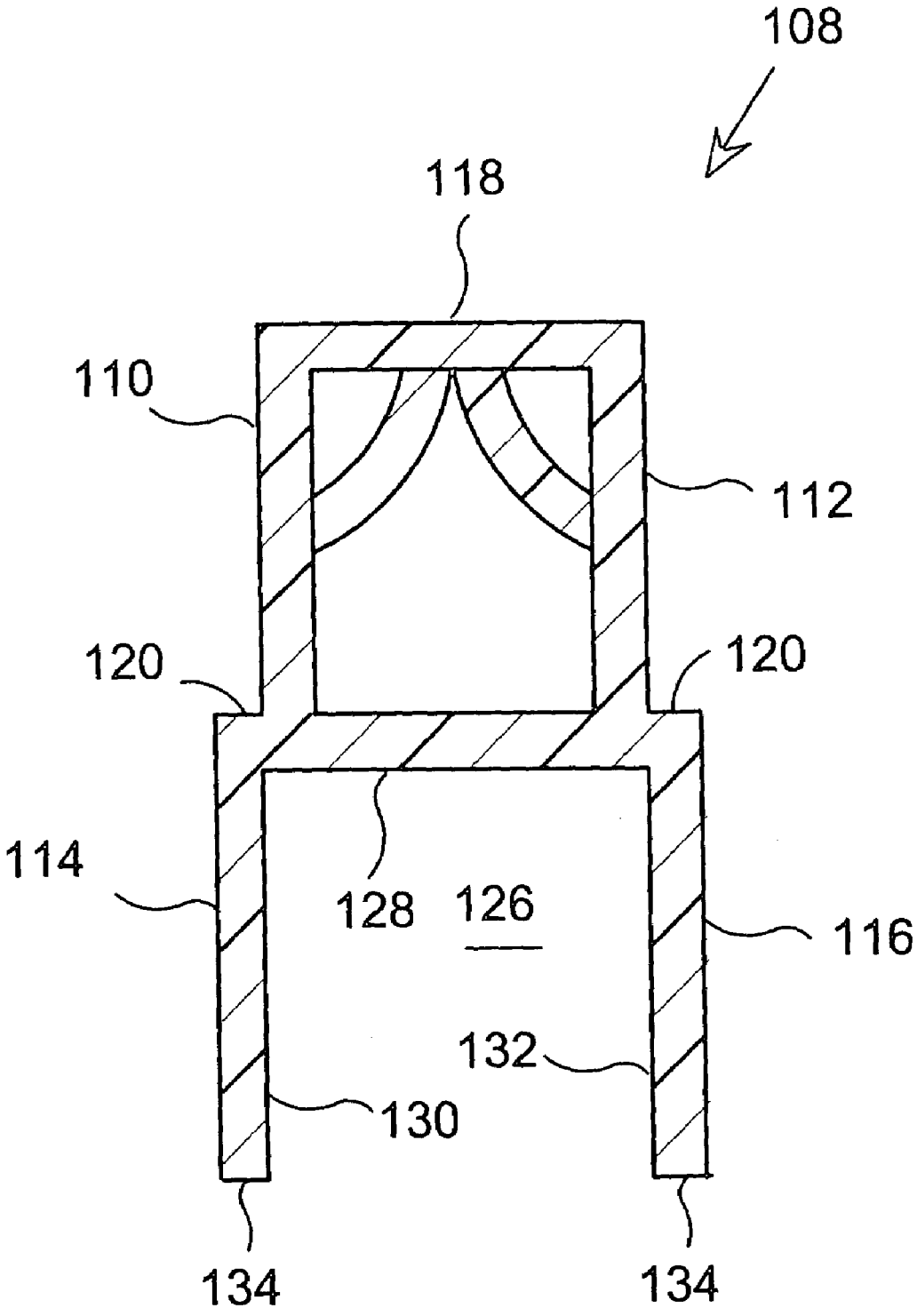
FIG. 10 is a cross sectional view of the frame insert

Referring to FIG. 10, shown is a cross sectional view taken from FIG. 9 as indicated. The frame insert has an integral support structure 48 between the spaced apart upper first wall 110 and upper second wall 112 having a top surface 118 therebetween. The frame insert 108 also has spaced apart lower walls 114, 116 that are offset from the upper walls 110, 112 by a ledge 120. The lower wall 114, 116 house the frame insert channel 126 having a top surface 128, first channel wall 130 and second channel wall 132. Also shown is the frame insert bottom surface 134.

The frame insert can be placed into a predetermined channel in the frame and or T-bar member and act as a track guide or stop in cooperation with the window/door sash. It should be noted that additionally by routing a channel in the upper surface and placing a spring within the base the frame insert can function as the guide for single, double and triple hung windows.

Figure 11:
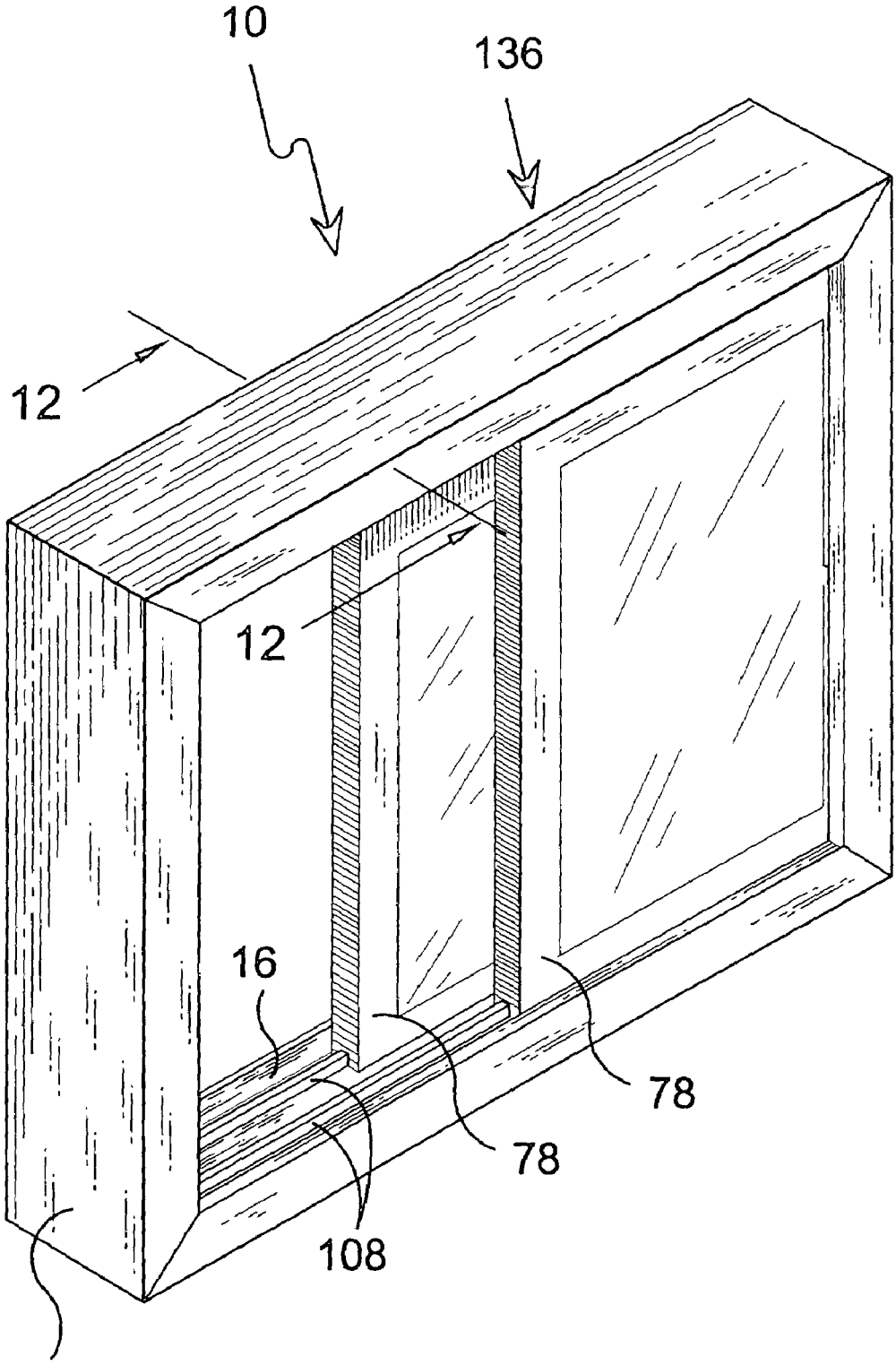
FIG. 11 is a perspective view of a double slider window using the components of the present invention.

Referring to FIG. 11, shown is a double slider window 136 using the components of the present invention. Depicted are four lengths of frame 12 bonded by means well known within the art to form a frame. The interior wall surface 16 covering two of the channels has been removed for the placement therein of frame inserts 108 for two sliding glass panels. Each of the glass panels has sash members 78 riding on frame inserts 108 and forming a frame for the placement therein of the glass. The glass line of the window is defined as the exterior lines where the glass is viewable as opposed to being enclosed by the sash 78. Because the frame 12 and sash 78 are of consistent thickness from the periphery wall of the window to the glass line various window types can be combined having a common glass line horizontally and vertically.

Figure 12:
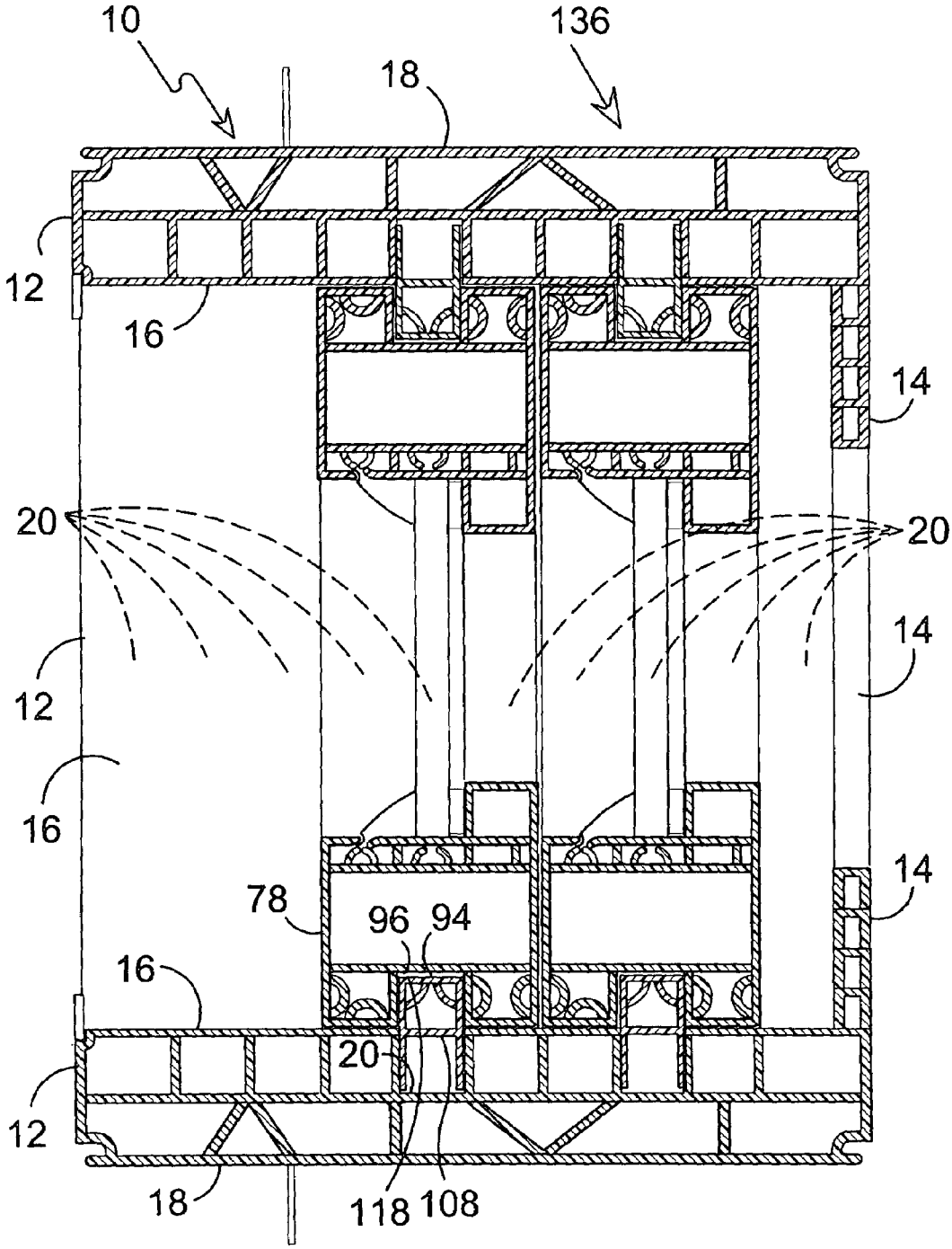
FIG. 12 is cross sectional side view of a double slider window.

Referring to FIG. 12, shown is a cross sectional view taken from FIG. 11 as indicated. Shown is a double slider window 136. One possible placement of the frame inserts 108 is shown. The frame member 12 having a frame flange member 14, an upper surface 16 and a lower spaced away surface 18 has a plurality of concealed channels 20 that can be accessed through selective removal of the material 16 thereover whereby frame insert 108 can be positioned therein providing a track projecting from the frame member top surface 16. The sash 78 having channel 94 is position on frame insert 108 whereby sash channel top surface 96 engages frame insert top surface 118 providing means for sliding the window along track 108. An additional frame insert, not shown, may be positioned vertically between horizontal frame inserts so that the slider forms a weather seal to the frame in the closed position. The prior art does not provide placement choices for window types.

Figure 13:
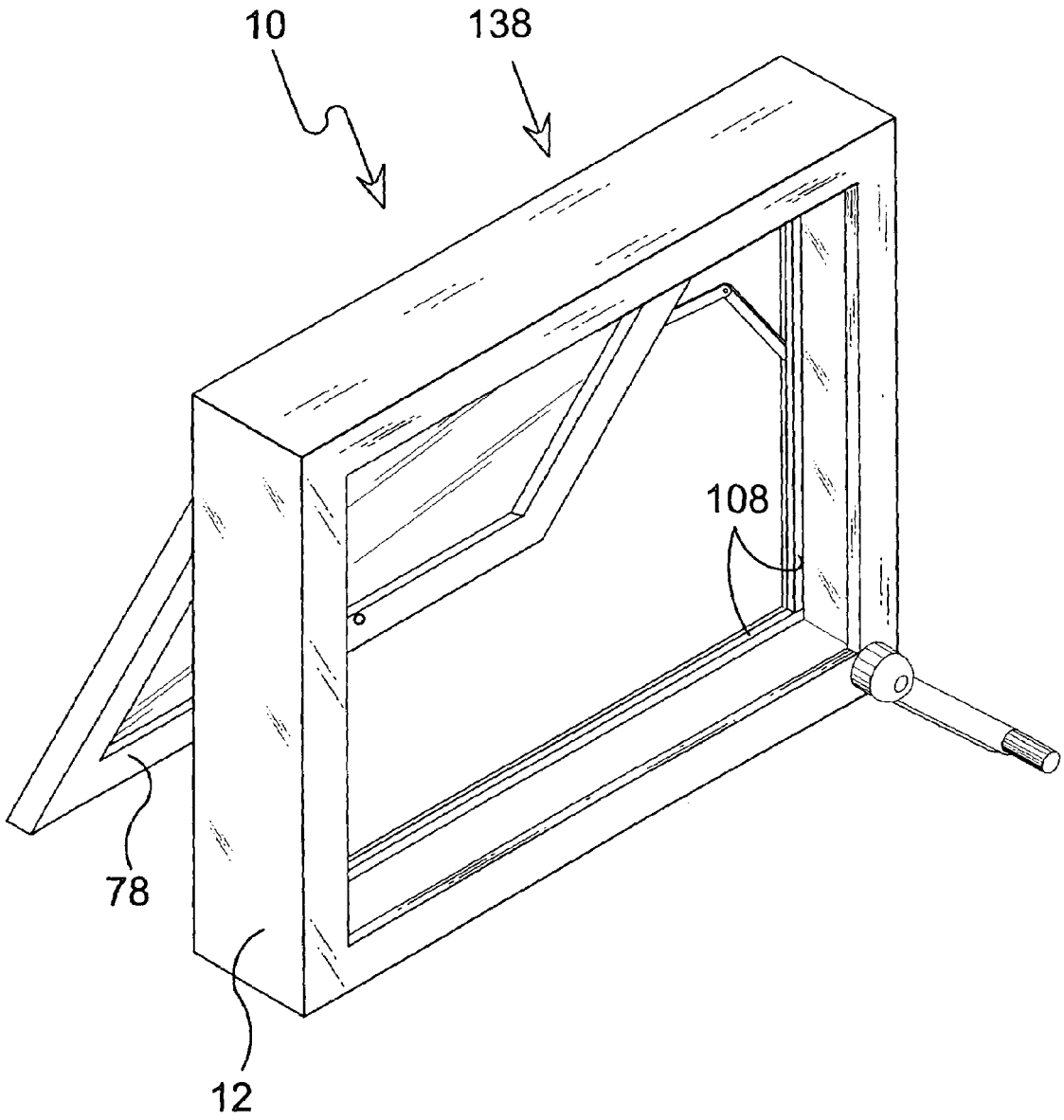
FIG. 13 is a perspective view of various components of the present invention used to create an awning window.

Referring to FIG. 13, shown is a perspective view of various components of the present invention used to create an awning window 138. Shown is lengths of frame 12 forming a housing for a horizontal pivoting window 138. The glass member is peripherally encased by lengths of sash 78 and frame inserts 108 are selectively positioned to form a stop for the closed position of the pivoting window. The crank handle and hardware fixedly positioned to the frame 12 and window sash 78 are well known within the art and are depicted for purposes of clarity in demonstrating one possible usage of the components of the present invention in forming a horizontal pivoting window.

Figure 14:
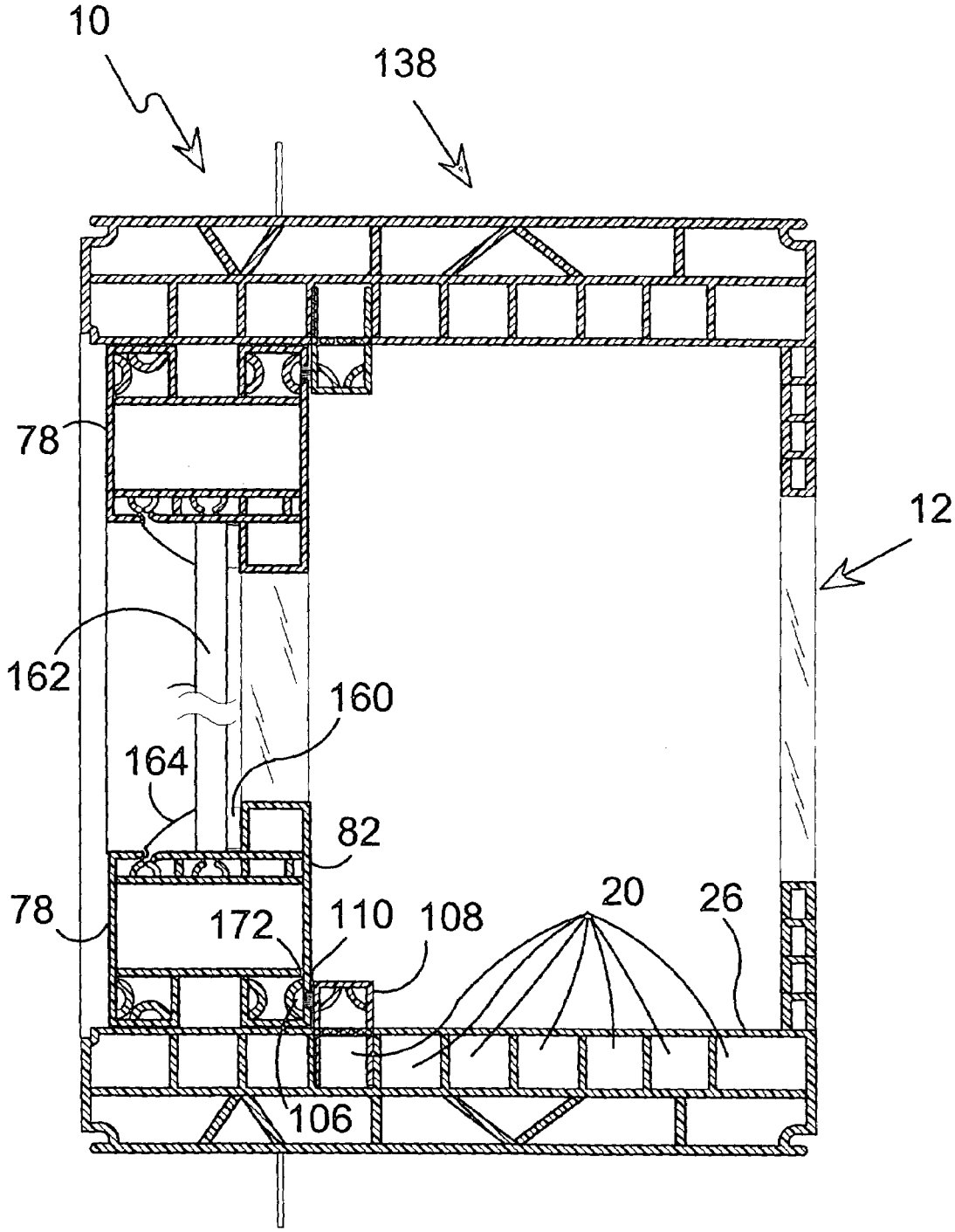
FIG. 14 is a sectional side view of the awning window.

Referring to FIG. 14, shown is a sectional side view of the awning window 138. Depicted is a side sectional view of FIG. 13 with the crank, crank hardware and hinge removed for clarity. Shown is the frame 12 having a plurality of concealed channels 20 where a channel 20 has been exposed by removing frame material 26. The channel 20 has a track member 108 inserted therein functioning as a window stop. The glass pane 162 is enclosed by lengths of sash 78 and is secured therein by retaining elements 160, 164 well known within the art. The sash 78 as shown has weather stripping 172 applied to the mating sash 82 and window stop surfaces 110. This can be applied by bonding to either surface or by cutting a channel 106 and anchoring the weather stripping 172 within said channel. The placement of the awning window 138 and channel 20 selected for the window stop 108 can be placed in various locations.

Figure 15:
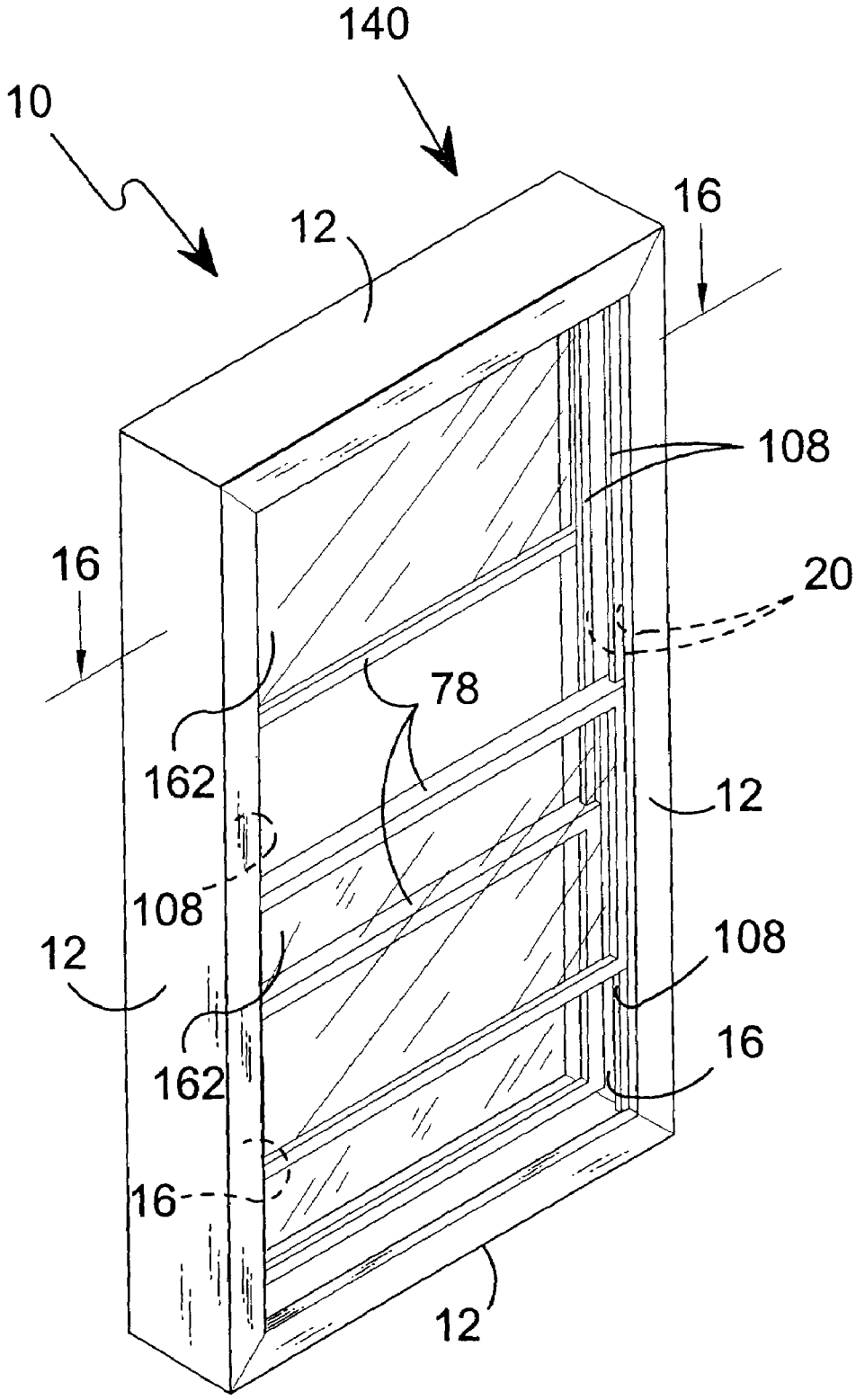
FIG. 15 is a perspective view of a triple hung window using the components of the present invention.

Referring top FIG. 15, shown is a perspective view of a triple hung window 140 using the components of the present invention. Depicted are four lengths of frame 12 bonded by means well known within the art to form a frame. The interior wall surface 16 covering three of the frame channels 20 has been removed for the placement therein of frame inserts 108 for three sliding glass panels. Each of the glass panels has sash members 78 riding on vertical frame inserts 108 and forming a frame for the placement therein of the glass 162. The two horizontal window frame members 12 have one frame insert 108 forming the trim for the window in the closed position. The glass line of the window is defined as the exterior lines where the glass is viewable as opposed to being enclosed by the sash 78. Because the frame 12 and sash 78 are of consistent thickness from the periphery wall of the window to the glass line various window types can be combined having a common glass line horizontally and vertically.

Figure 16:
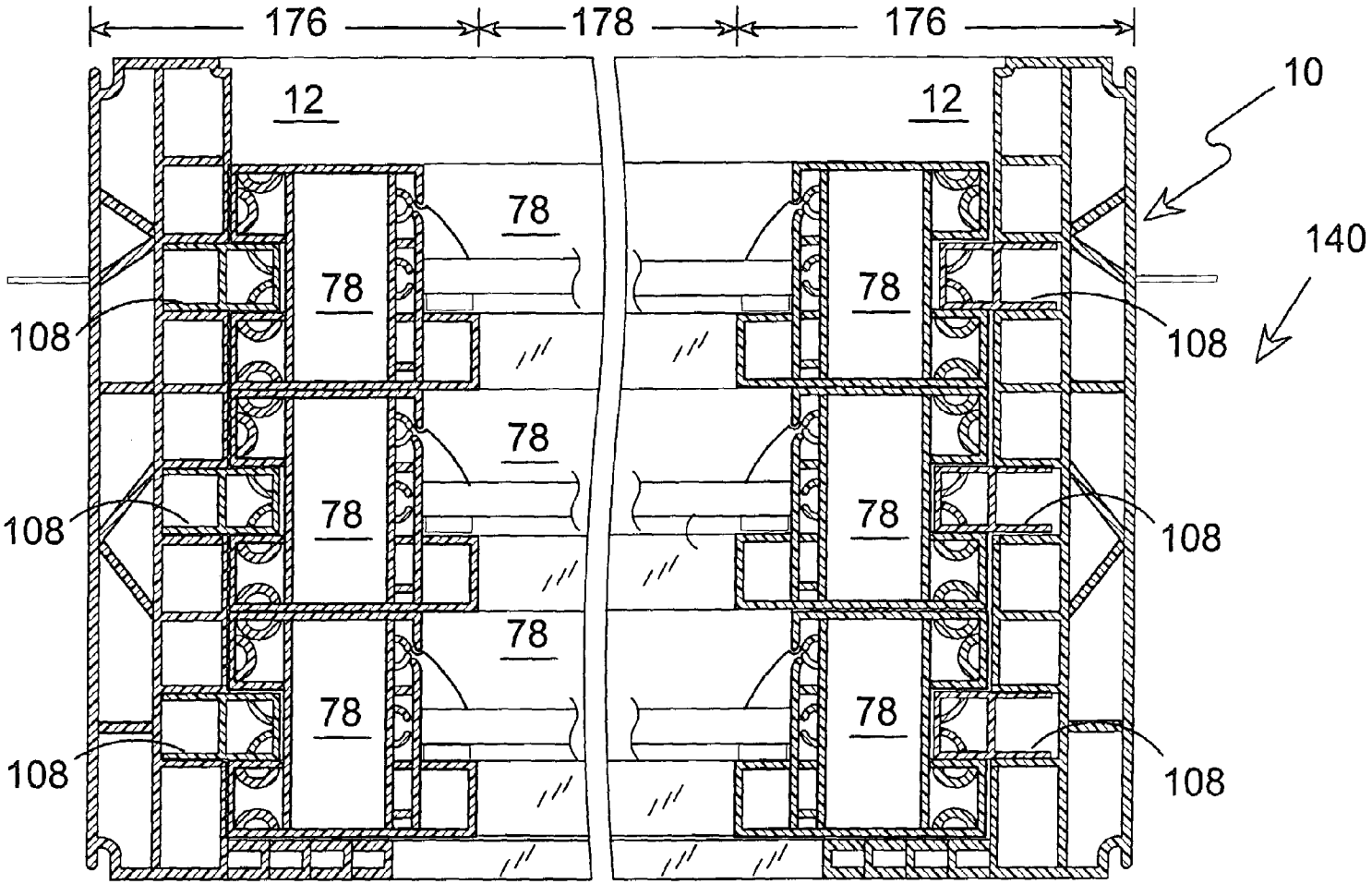
FIG. 16 is a cross sectional top view of the triple hung window.

Referring to FIG. 16, shown is a cross sectional top view of the triple hung window 140. Shown is a top sectional view of the triple hung window 140 showing the three pairs of oppositely opposed vertical frame inserts 108 that are used to guide their respective sashed 78 window members. As shown each slidable window members is formed from lengths of sash 78 that straddle the frame inserts 108. Because of the consistent thickness of the frame and sash member 176 the glass line 178 of the triple hung window 140 on the horizontal and vertical is consistent with all of the other window type disclosed in the accompanying drawings. It should also be noted that while three pairs of vertical frame inserts 108 are used in the triple hung window 140, only one channeled frame insert is used on the top horizontal frame member and the bottom horizontal frame member.

Figure 17:
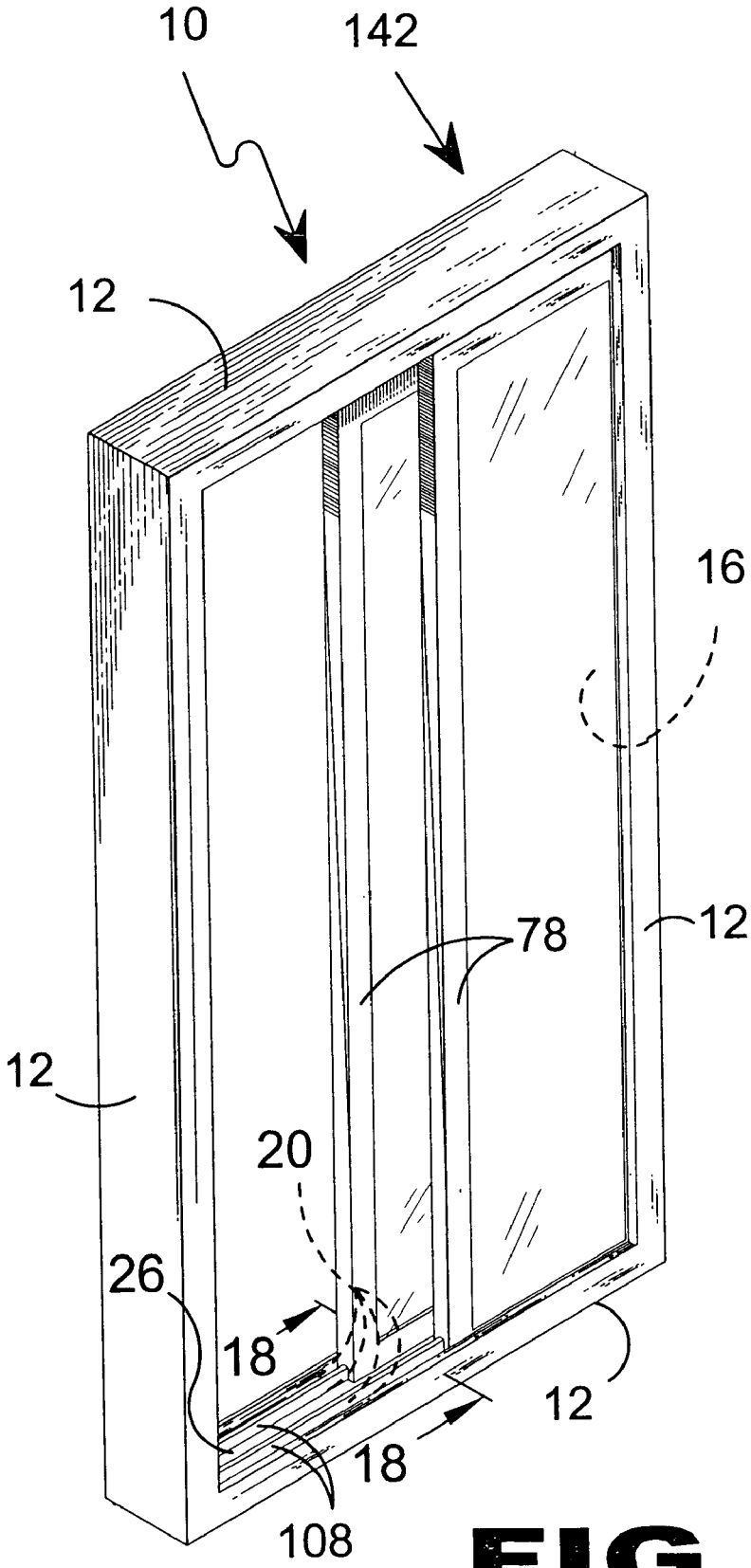
FIG. 17 is a perspective view of a double slider patio door using the components of the present invention.

Referring to FIG. 17, shown is a perspective view of a double slider patio door 142 using the components frame 12, sash 78 and frame insert 108 of the present invention. Depicted are four lengths of frame 12 bonded by means well known within the art to form a frame. The interior wall surface 26 covering three of the horizontal channels 20 has been removed for the placement therein of frame inserts 108 for two sliding glass doors and the third is used for a sliding screen door. Each of the doors has sash 78 members riding on horizontal frame inserts 108. The doors could close flush with the vertical frame members 16 or inserts could be used as vertical seats for the doors.

Figure 18:
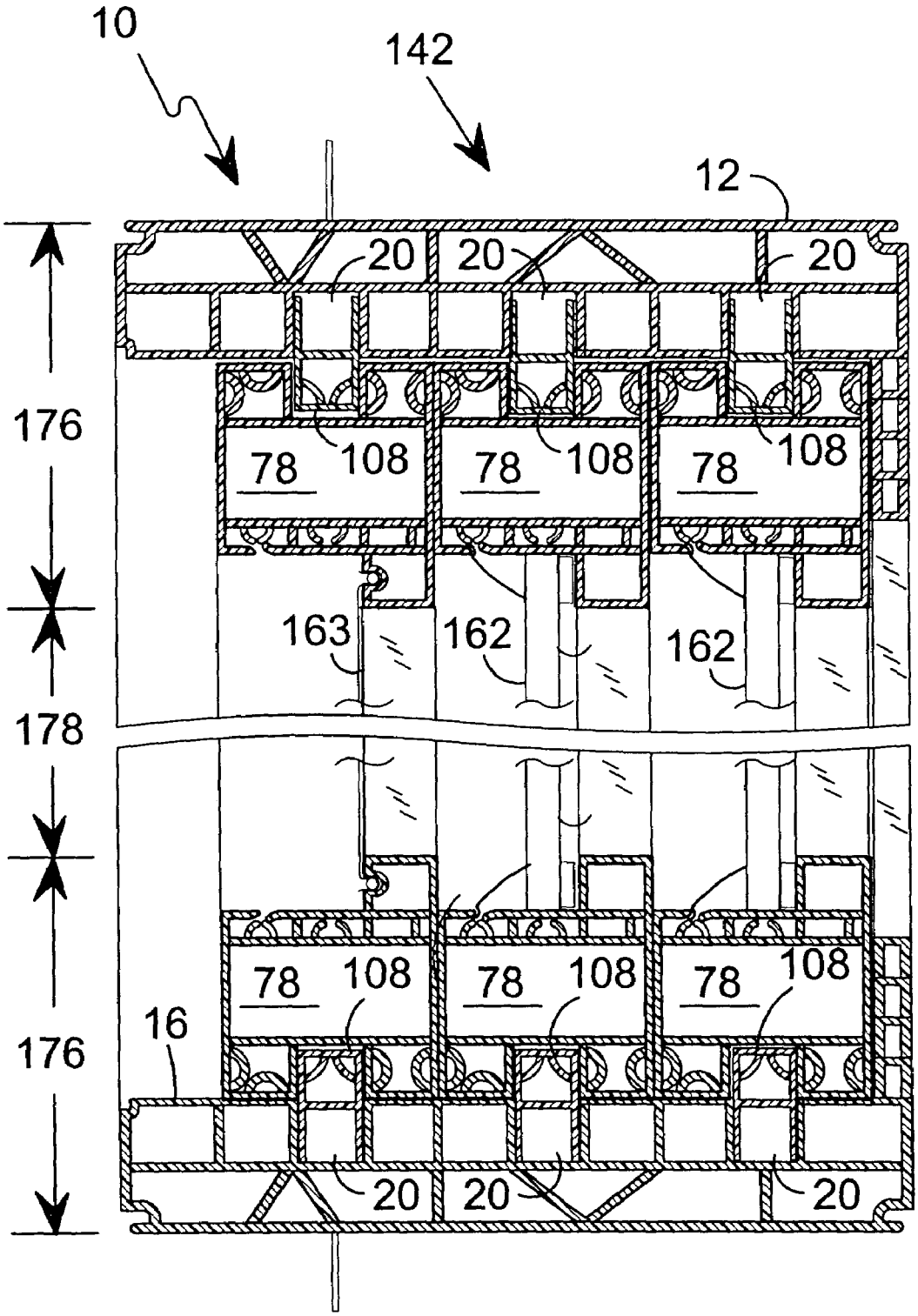
FIG. 18 is a cross sectional side view of the double slider patio door.

Referring to FIG. 18, shown is a cross sectional side view of the double slider patio door 142. Shown is a cross sectional view of the horizontal frame 12 and sash members 78 of the sliding patio doors 142. The interior wall surface 16 covering three of the horizontal channels 20 has been removed for the placement therein of frame inserts 108 for the two sliding glass 162 doors and the sliding screen 163 door. Each of the doors has sash members 78 riding on horizontal frame inserts 108. The doors could close flush with the vertical frame members 16 or inserts could be used as vertical seats for the doors. The glass line 178 of the doors is defined as the exterior lines where the glass is viewable as opposed to being enclosed by the sash. Because the frame and sash 176 are of consistent thickness from the periphery wall of the window to the glass line, various window/door types can be combined having a common glass line 178 horizontally and vertically.

Figure 19:
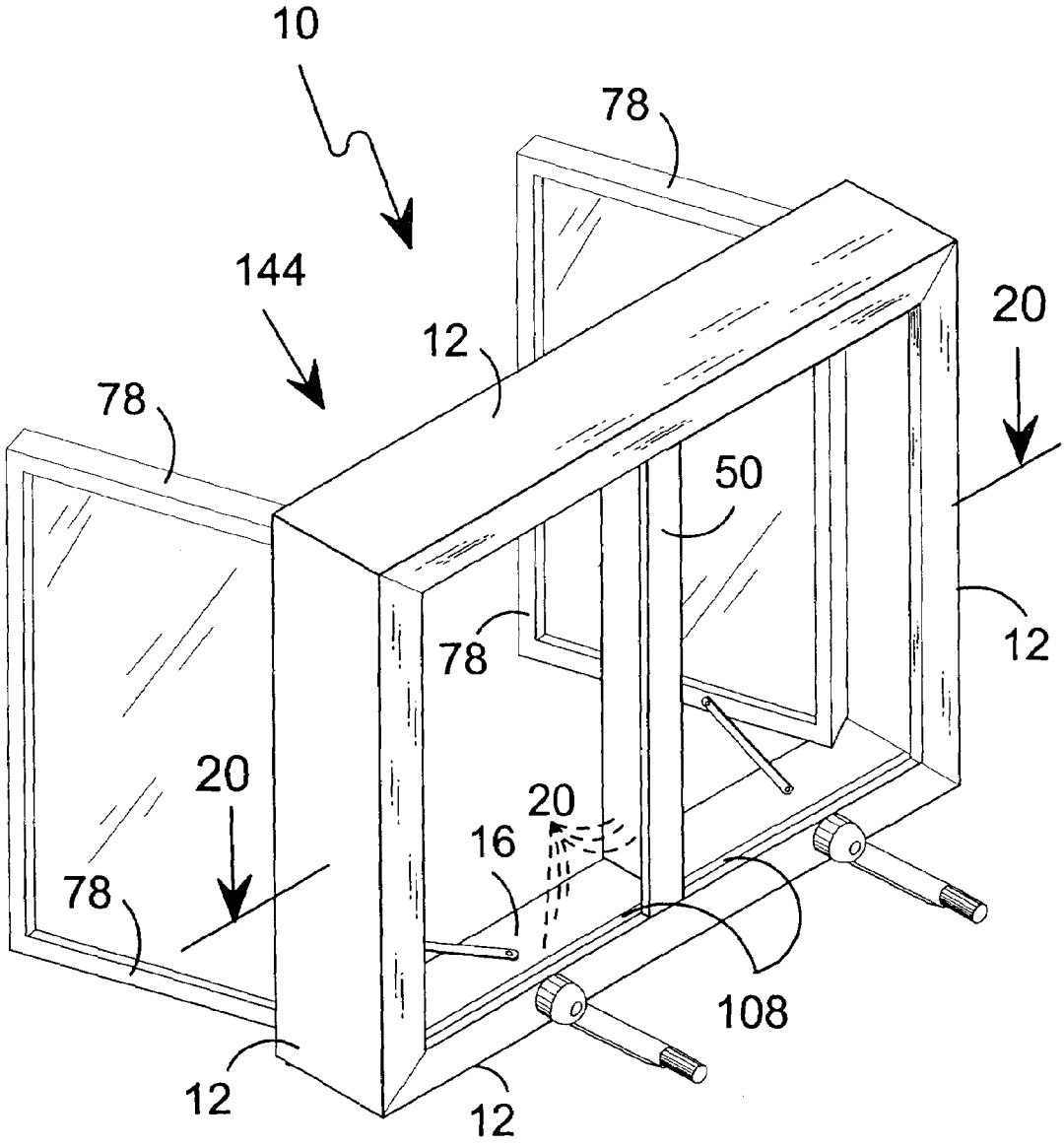
FIG. 19 is a perspective view of a casement window using the components of the present invention.

Referring to FIG. 19, shown is a perspective view of a casement window 144 using the components of the present invention. Shown are frame elements 12 bonded by means well known within the art to form a frame. The interior wall surface 16 covering one of the horizontal channels 20 has been removed for the placement therein of frame inserts 108 forming stops for two crank handled windows. Each of the windows has sash members 78 forming the glass member which are separated using the t-bar 50. The t-bar 50 has a thickness 70 substantially equivalent to twice the frame thickness 38 and has mating concealed channels 20 for each side of the frame. The windows and stops can be selectively positioned using any of the concealed channels 20.

Figure 20:
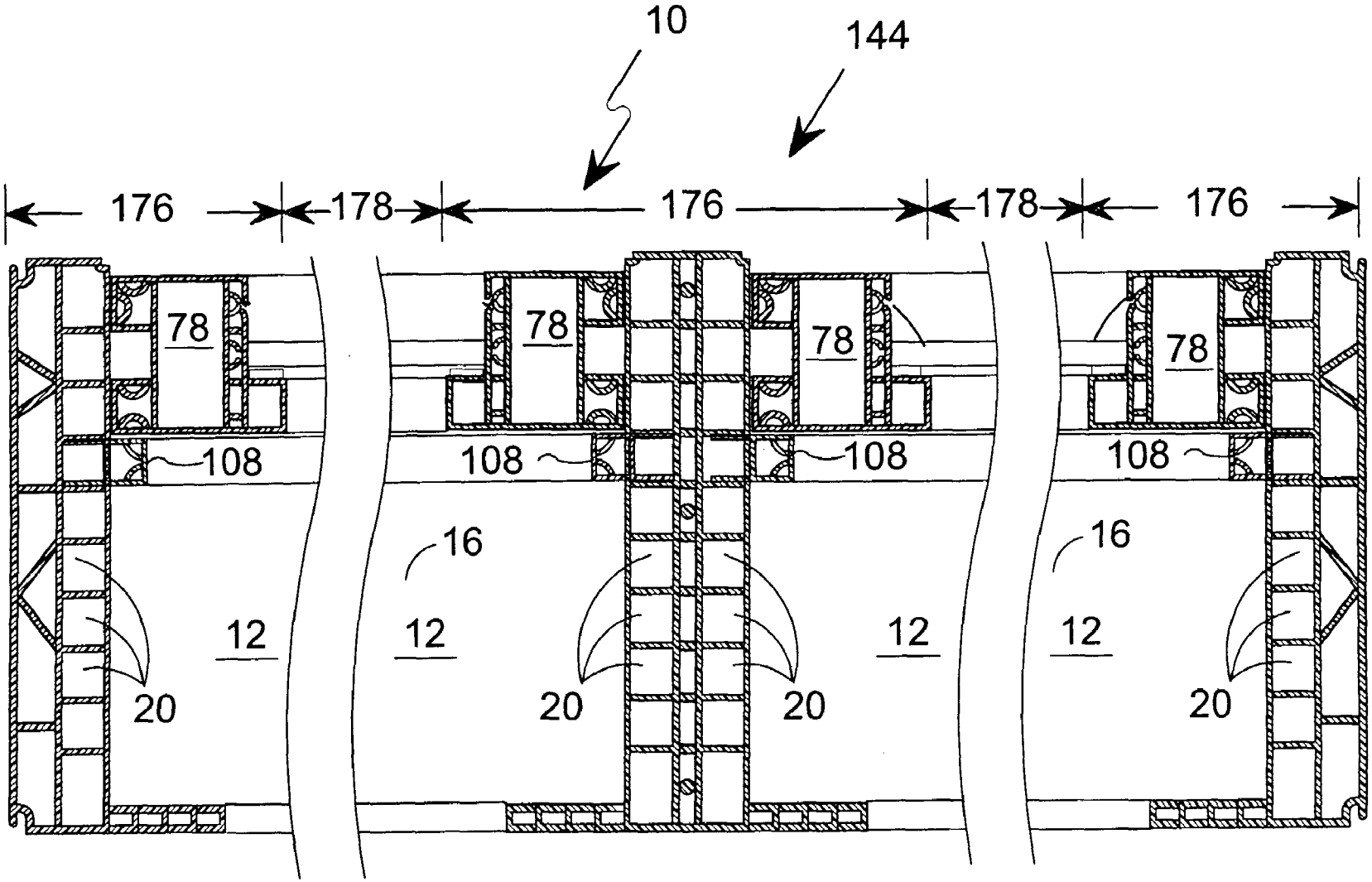
FIG. 20 is a cross sectional view of the casement window.

Referring to FIG. 20, shown is a cross sectional view of the casement window 144. Shown are the opposing frame members 12 and centrally positioned t-bar 50 separating the two casement windows. The crank handle and hardware has been excluded for clarity purposes. The interior wall surface 16 covering one of the horizontal channels 20 has been removed for the placement therein of frame inserts 108 forming stops for two crank handled windows. Each of the windows has sash members 78 forming the glass member that are separated by the t-bar 50. The t-bar has a thickness 70 substantially equivalent to twice the frame thickness 38 and has mating concealed channels 20 for each side of the frame. The windows and stops can be selectively positioned using any of the concealed channels. The glass line 178 of the window is defined as the exterior lines where the glass is viewable as opposed to being enclosed by frame members. Because the frame and sash 176 are of consistent thickness from the exterior of the window to the glass line various window types can be combined having a common glass line 178 horizontally and vertically.

Figure 21:
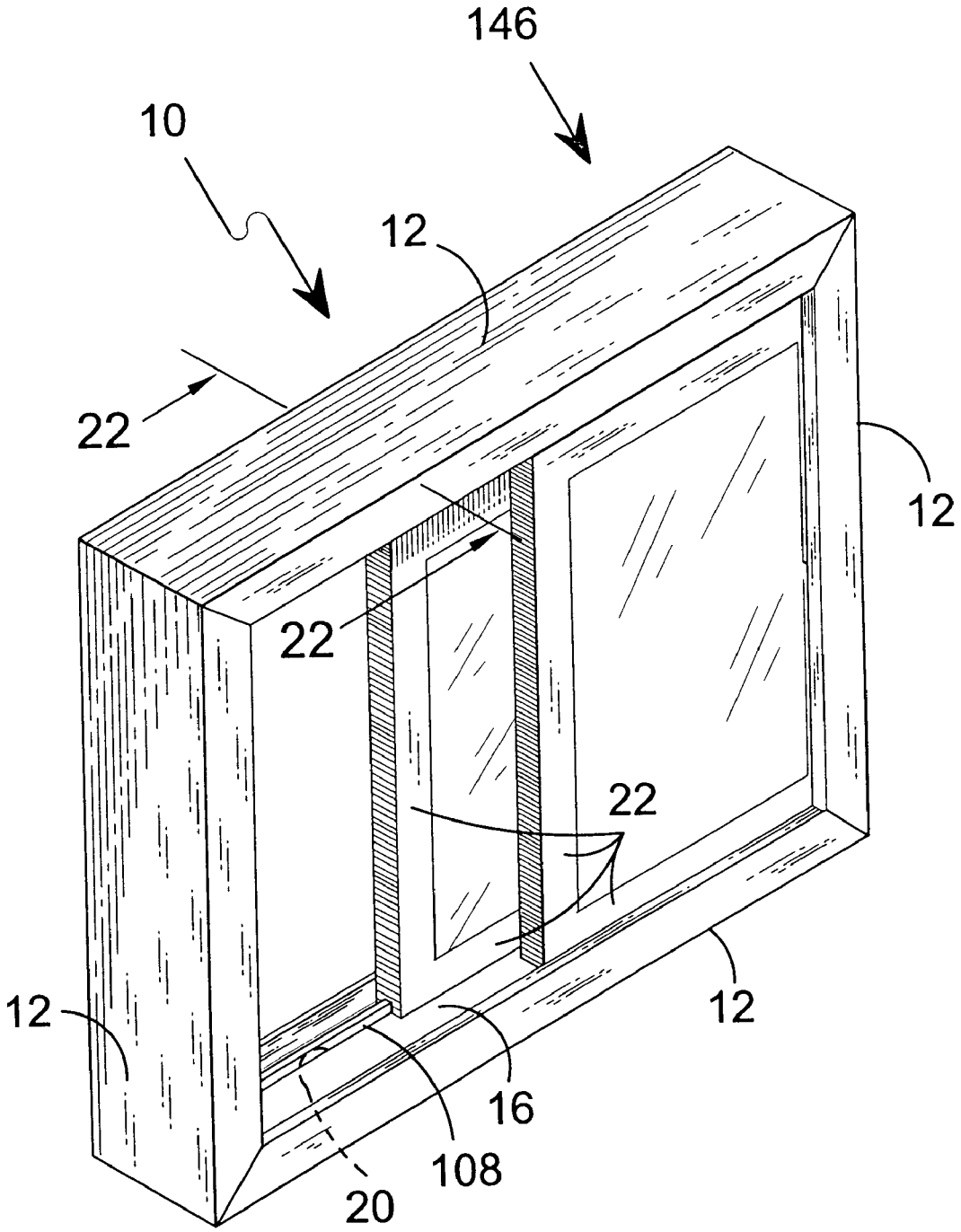
FIG. 21 is a perspective view of a single slider window using the components of the present invention

Referring to FIG. 21, shown is a perspective view of a single slider window 146 using the components of the present invention. Depicted are four lengths of frame 12 bonded by means well known within the art to form a frame. The interior wall surface 16 covering the predetermined concealed channels 20 selected has been removed. The material removed is proportionally to the length of frame insert 108 used. For fixed windows the length could be less than the width of the window unit if any at all. Thereby providing means for securely fastening a window element by using some portion of a concealed channel as a receptacle for an anchoring element. As shown for this window type there are two glass panels. One of the glass panels is fixed and one of them sliding on an insert 108. Each of the glass panels has sash members 78 forming a frame for the placement therein of the glass.

Figure 22:
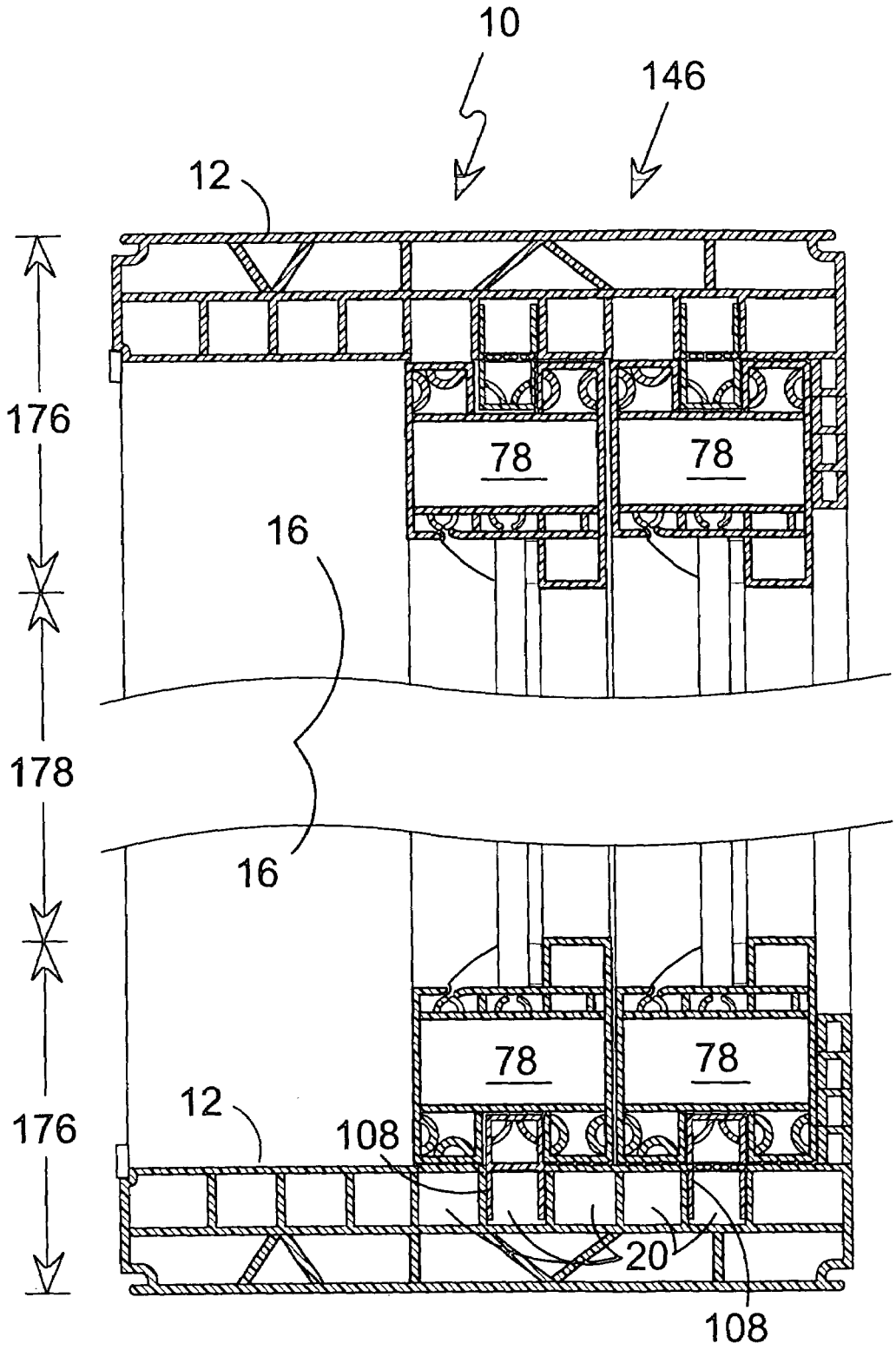
FIG. 22 is a cross sectional side view of the single slider window.

Referring to FIG. 22, shown is a cross sectional side view of the single slider window 146 taken from FIG. 21 as indicated. One possible placement of the frame inserts 108 is shown. The frame 12 interior wall 16 covering concealed channels 20 has some material 16 removed for the placement therein of frame insert 108. The opposing base legs of the sash 78 straddle the frame insert 108 member projecting beyond the planar interior frame surface. An additional frame insert, not shown, may be positioned vertically between horizontal frame insert so that the slider forms a weather seal to the frame in the closed position. The prior art does not provide placement choices for window types. The glass line 178 of the window is defined as the exterior lines where the glass is viewable as opposed to being enclosed by frame members. Because the frame and sash 176 are of consistent thickness from the exterior of the window to the glass line various window types can be combined having a common glass line 178 horizontally and vertically.

Figure 23:
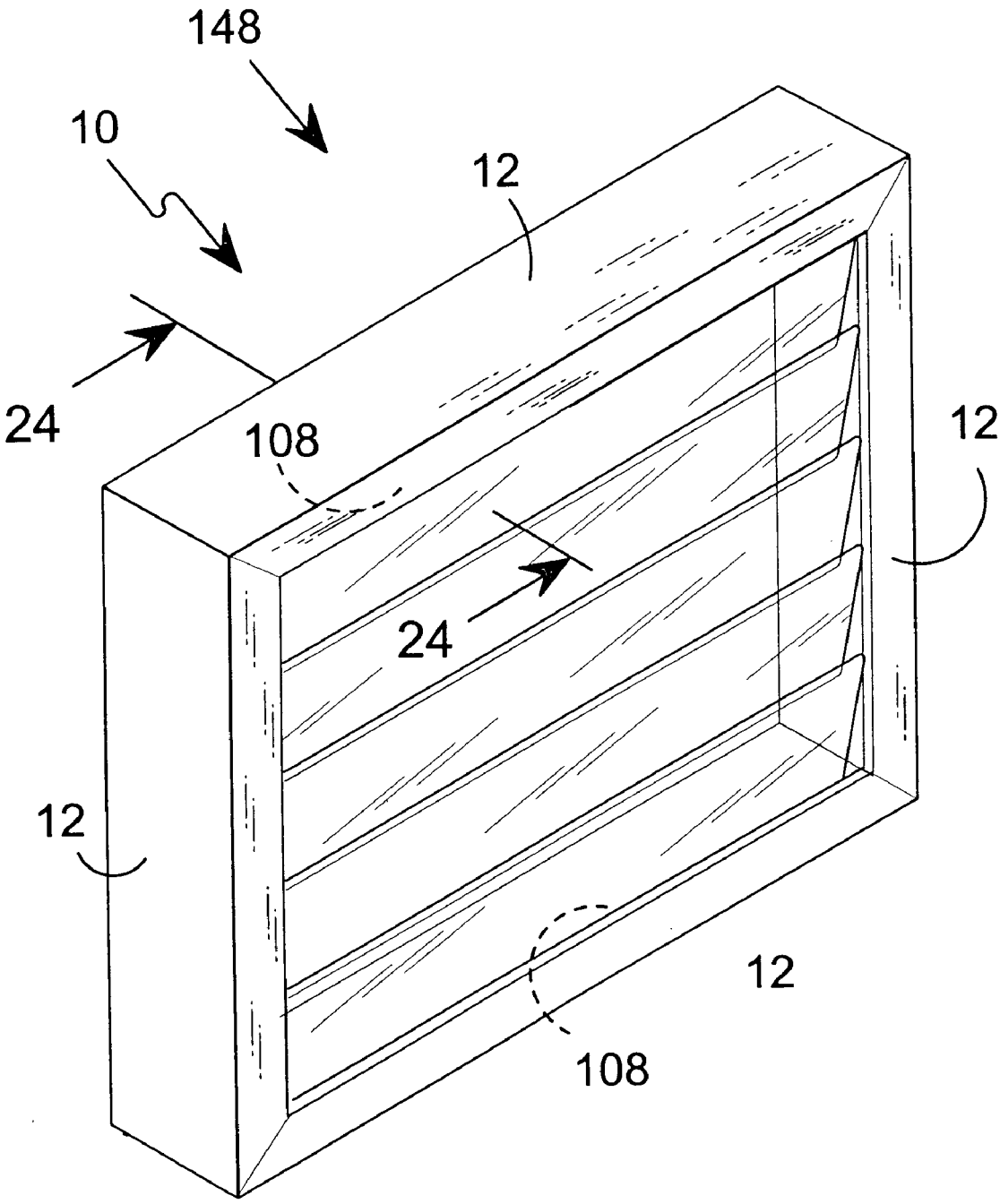
FIG. 23 is a perspective view of a jalousie window using the components of the present invention

Referring to FIG. 23, shown is a perspective view of a jalousie window 148 using the components of the present invention. The frame 12 is formed from four lengths of frame 12 bonded by means well known within the art. The interior wall surface 16 covering two of the horizontal channels 20 has been removed for the placement therein of frame inserts 108 that form a weather seal for the window in the closed position.

Figure 24:
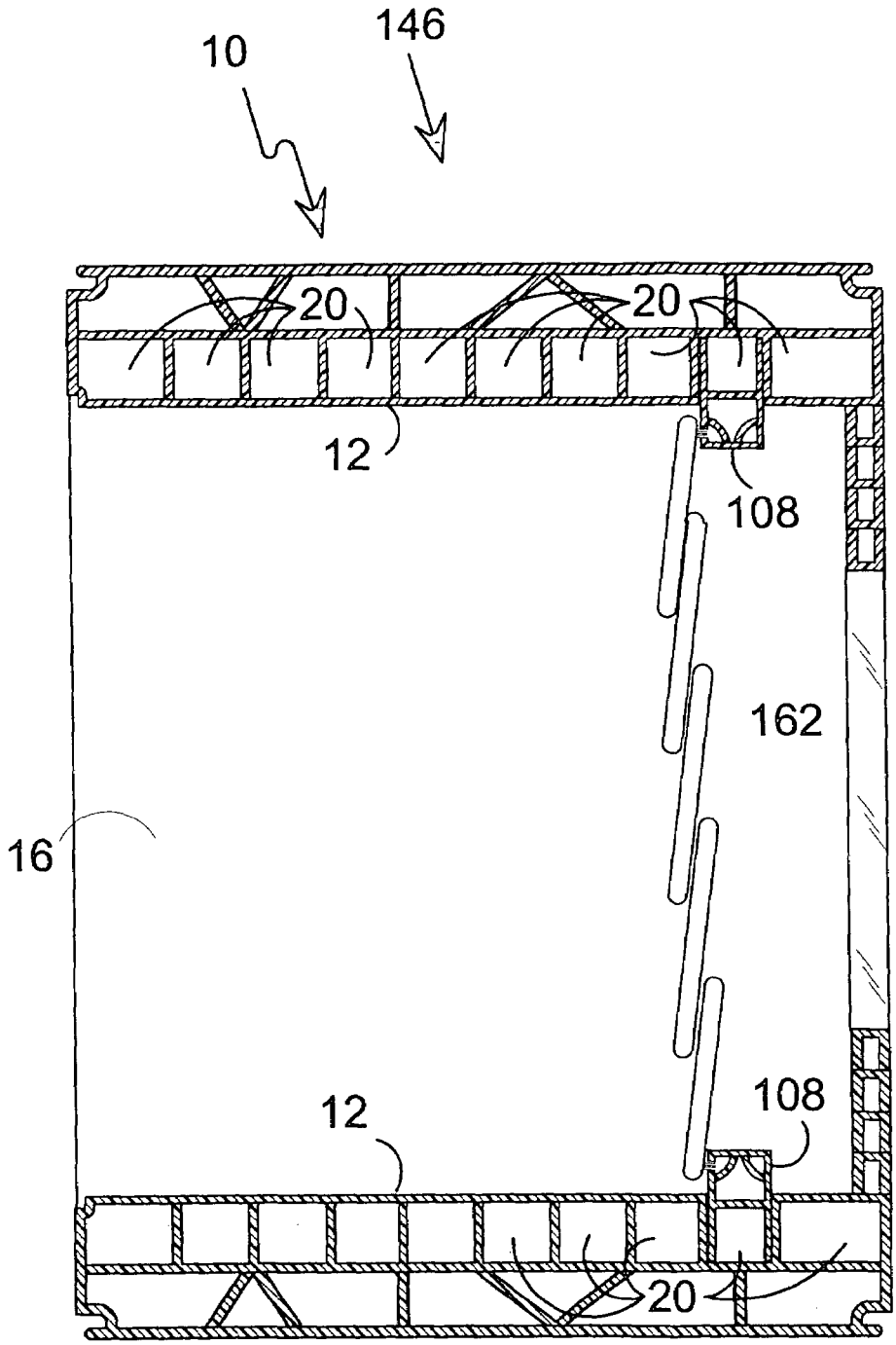
FIG. 24 is sectional side view of a jalousie window.

Referring to FIG. 24, shown is a cross sectional side view of a jalousie window 148 taken from FIG. 23 as indicated. One possible placement of the frame inserts 108 is shown. The opposing horizontal base inserts 108 forms a weather seal to the frame for the window in the closed position. The location of the hardware and inserts 108 is selectable to any of the remaining concealed channels 20. The prior art does not provide placement choices for window types.

Figure 25:
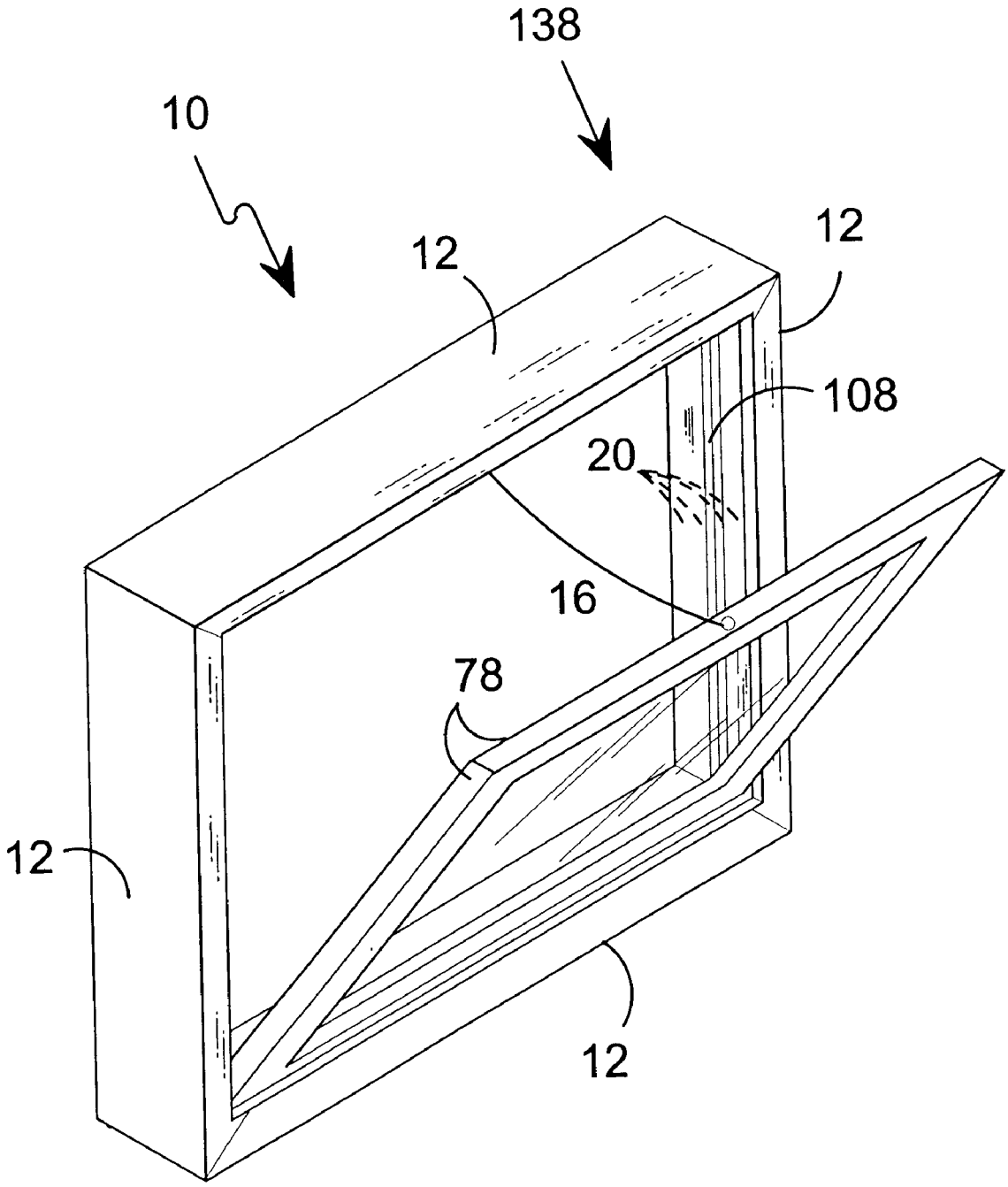
FIG. 25 is a perspective view of a bottom hinged single sash window using the components of the present invention

Referring to FIG. 25, shown is a perspective view of a bottom hinged single sash window 138 using the components of the present invention. Depicted are four lengths of frame 12 bonded by means well known within the art to form a frame. The interior wall surface 16 covering one of the channels 20 on both horizontal and both vertical surfaces is removed for the placement therein of frame insert members 108. The peripherally positioned inserts 108 form a weather seal when the window is in the closed position. The glass panel 162 has sash members 78 forming a frame for the placement therein of the glass. The glass line of the window is defined as the exterior lines where the glass is viewable as opposed to being enclosed by the sash. Because the frame and sash are of consistent thickness from the periphery wall of the window to the glass line various window types can be combined having a common glass line horizontally and vertically.

Figure 26:
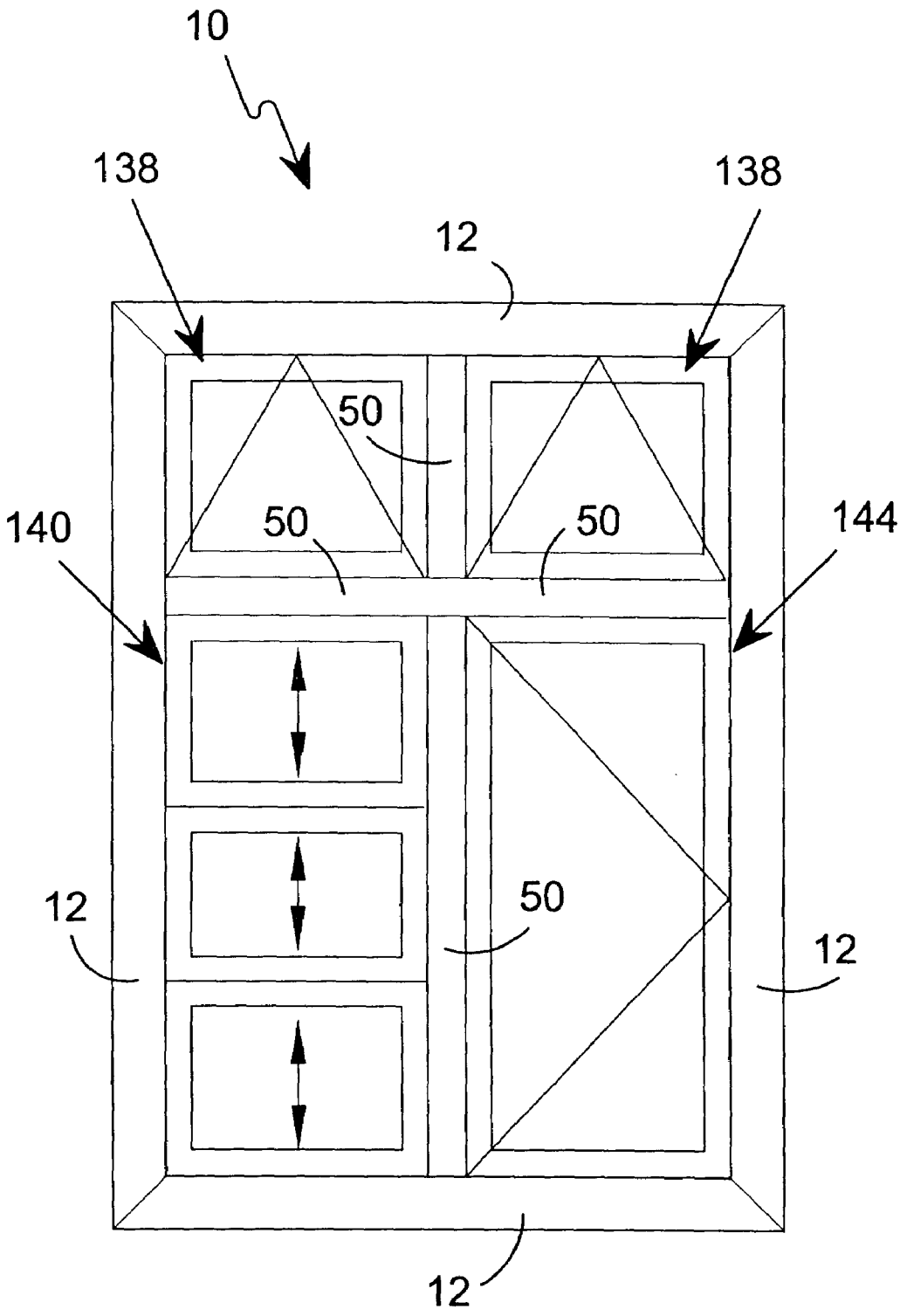
FIG. 26 is sectional view of the present invention with a plurality of windows installed within a common frame

Referring to FIG. 26, shown is the present invention with a plurality of windows 138, 140, 144 installed within a common frame 12. The t-bar 50 is a divider element having a plurality of concealed channels 20. The channels can have frame insert members 108 inserted therein to act as guides or stops for the sashes 78. The t-bar 50 permits the manufacturer to custom install a plurality of windows 138, 140, 144 and/or doors within a common frame.

Figure 27:
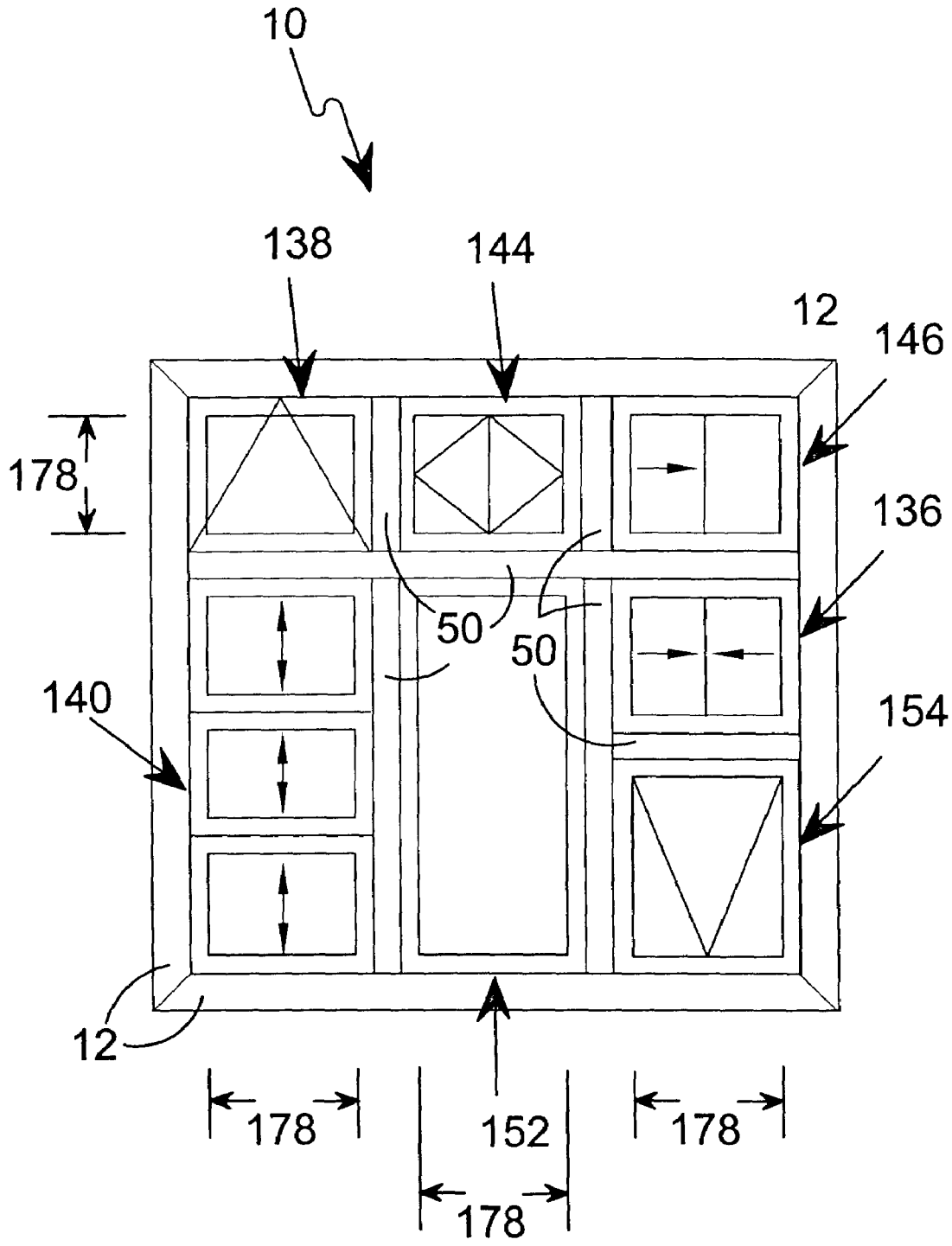
FIG. 27 is sectional view of the present invention with a plurality of windows installed within a common frame

Referring to FIG. 27, shown is the present invention with a plurality of windows 138, 140, 144, 146, 154, 152 installed within a common frame. The t-bar 50 is a divider element having a plurality of concealed channels 20. The channels 20 can have frame insert members 108 inserted therein to act as guides or stops for the sashes 78. The t-bar 50 permits the manufacturer to install a plurality of windows and/or doors within a common frame. The prior art does not provide placement choices for window types. The glass line 178 of the window is defined as the exterior lines where the glass is viewable as opposed to being enclosed by frame members. Because the frame and sash 176 are of consistent thickness from the exterior of the window to the glass line various window types can be combined having a common glass line 178 horizontally and vertically.

Figure 28:
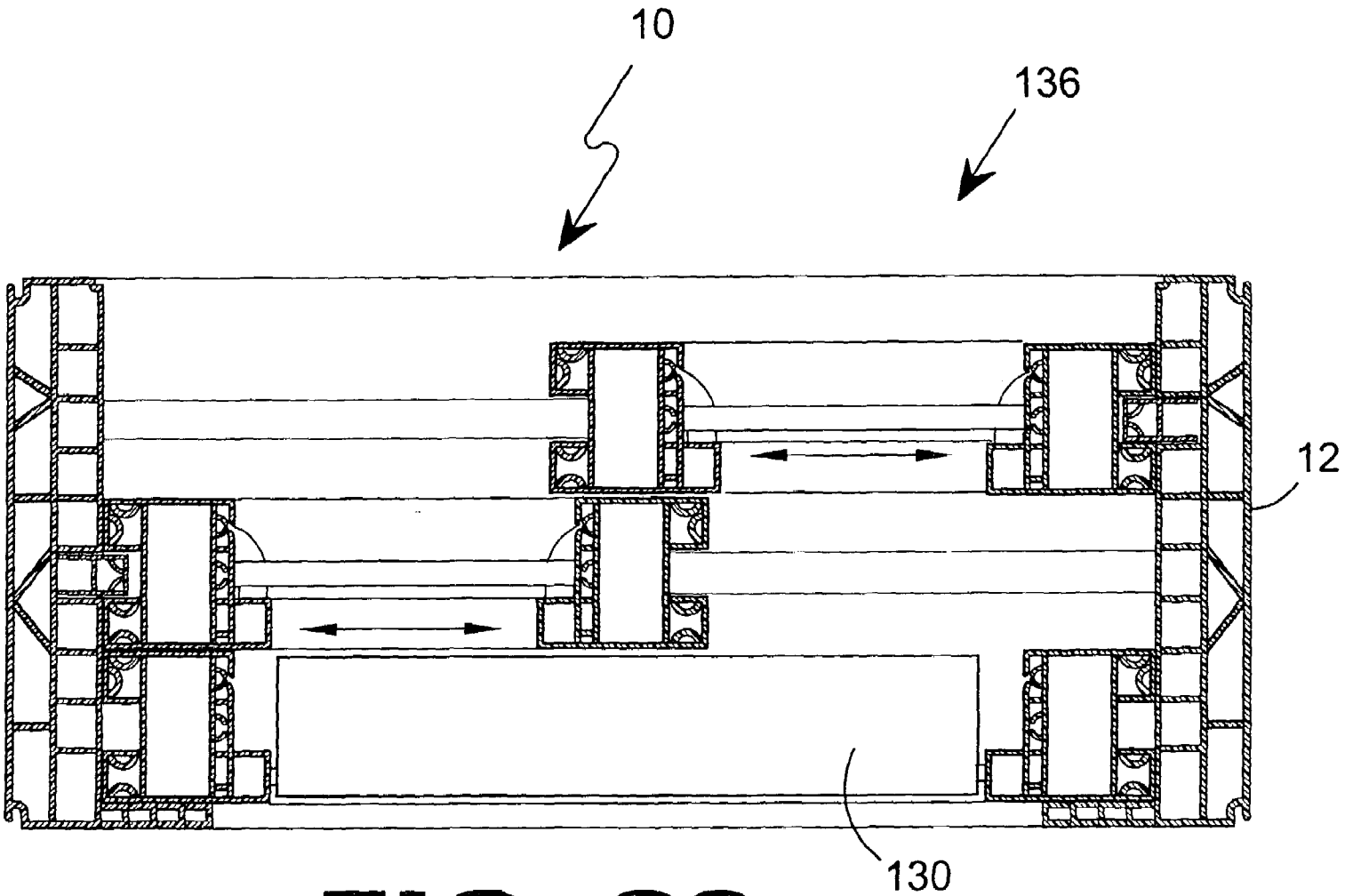
FIG. 28 is a cross sectional top view of the present invention.

Referring to FIG. 28, shown is a sectional top view of a double slider window 136 selectively set back within the frame 12 for the inclusion of frontally positioned shutters 180. The positioning of any window can be varied to accommodate additional window elements or additional window types. They can also be selectively positioned to suit individual preferences. It should also be noted that the latitude provided by the selective positioning of window components lends itself to crafting windows and combinations of windows conforming to stringent guidelines for window replacement of historical homes which presently are labor intensive custom built.

Figure 29:
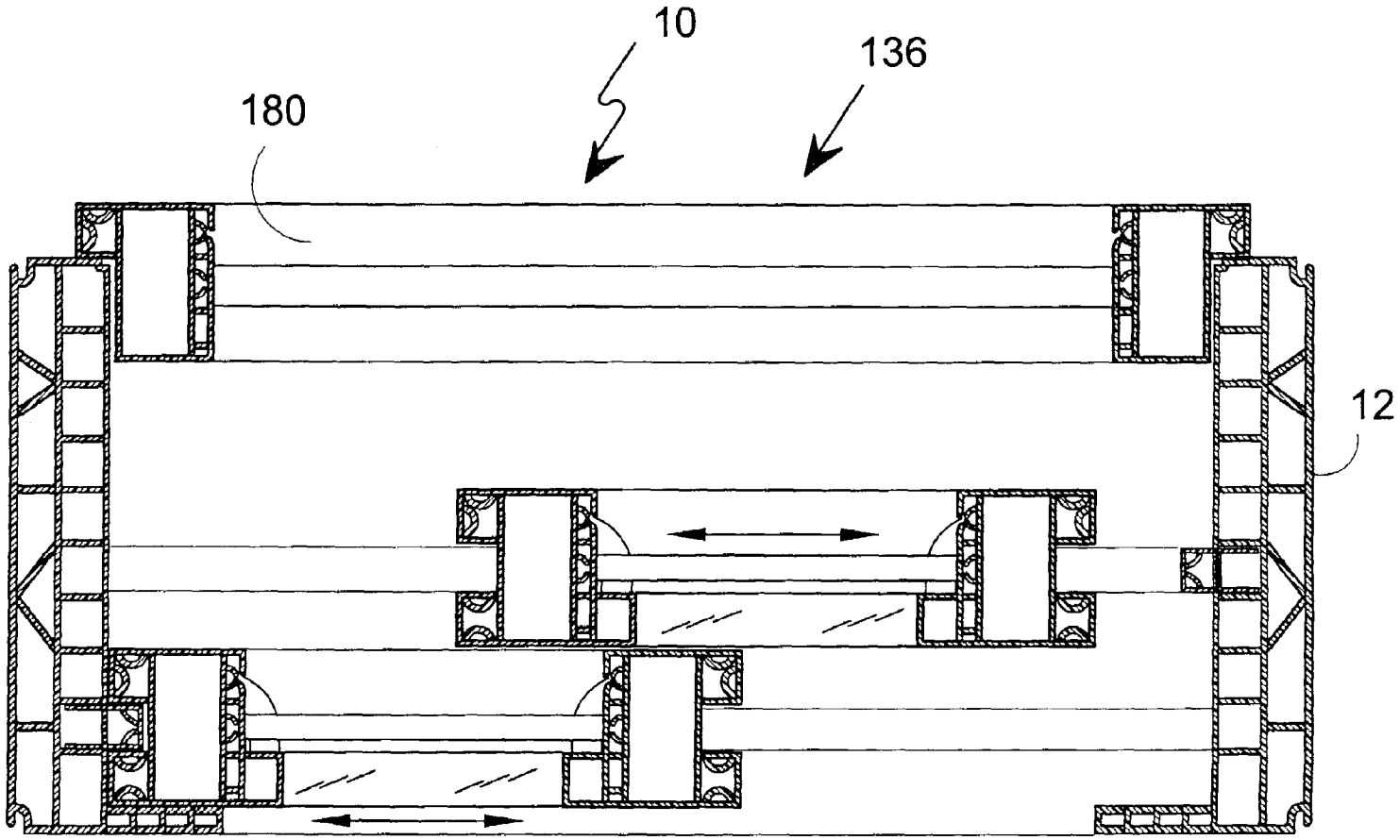
FIG. 29 is cross sectional top view of the present invention.

Referring to FIG. 29, shown is a sectional top view of a double slider 136 having a hurricane shutter or insulated storm panel or any other exterior that requires room.

Figure 30:
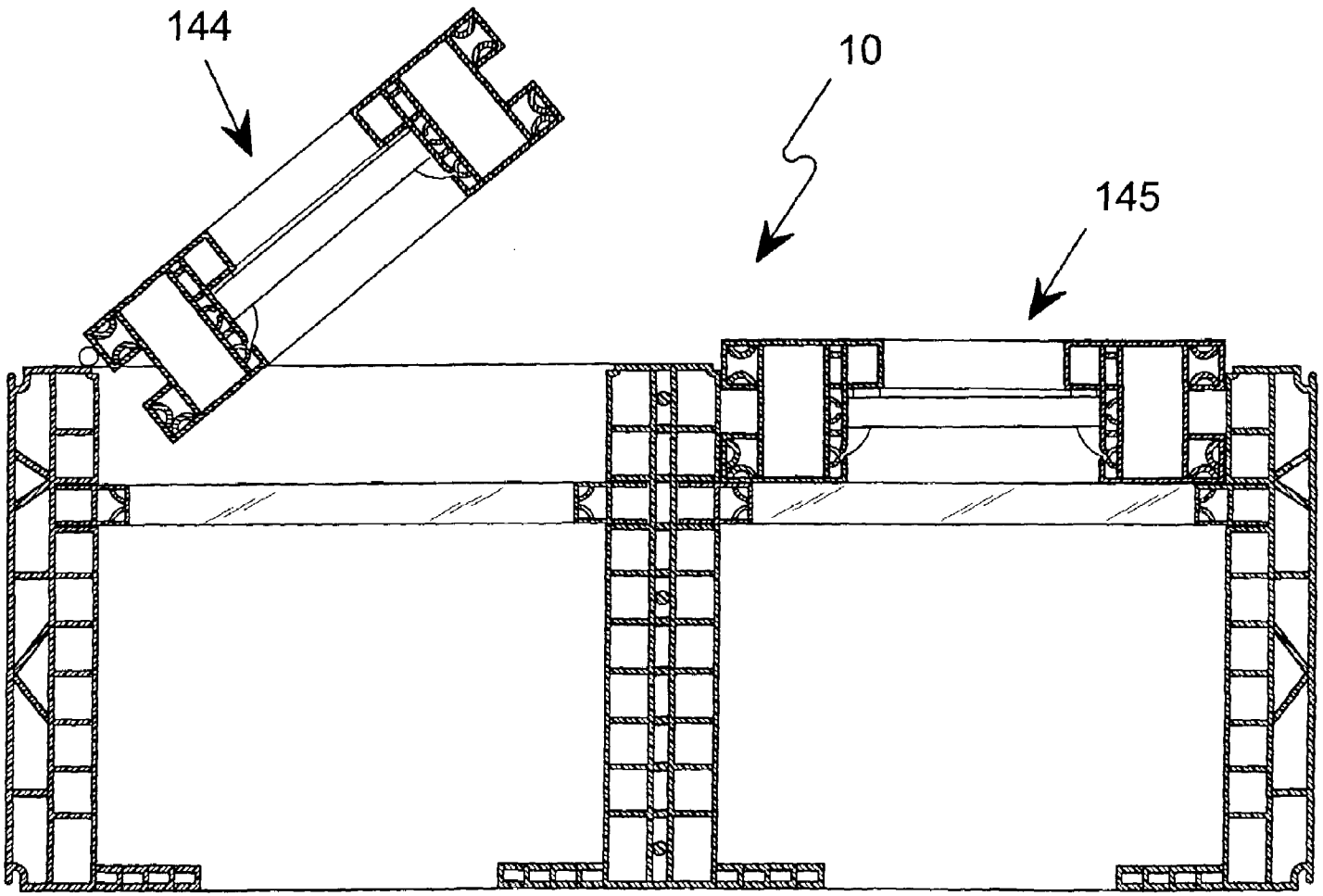
FIG. 30 is cross sectional top view of the present invention.

Referring to FIG. 30, shown is a sectional top view of a casement window 144 beside a picture window 145 within the frame of the present invention.

Figure 31:
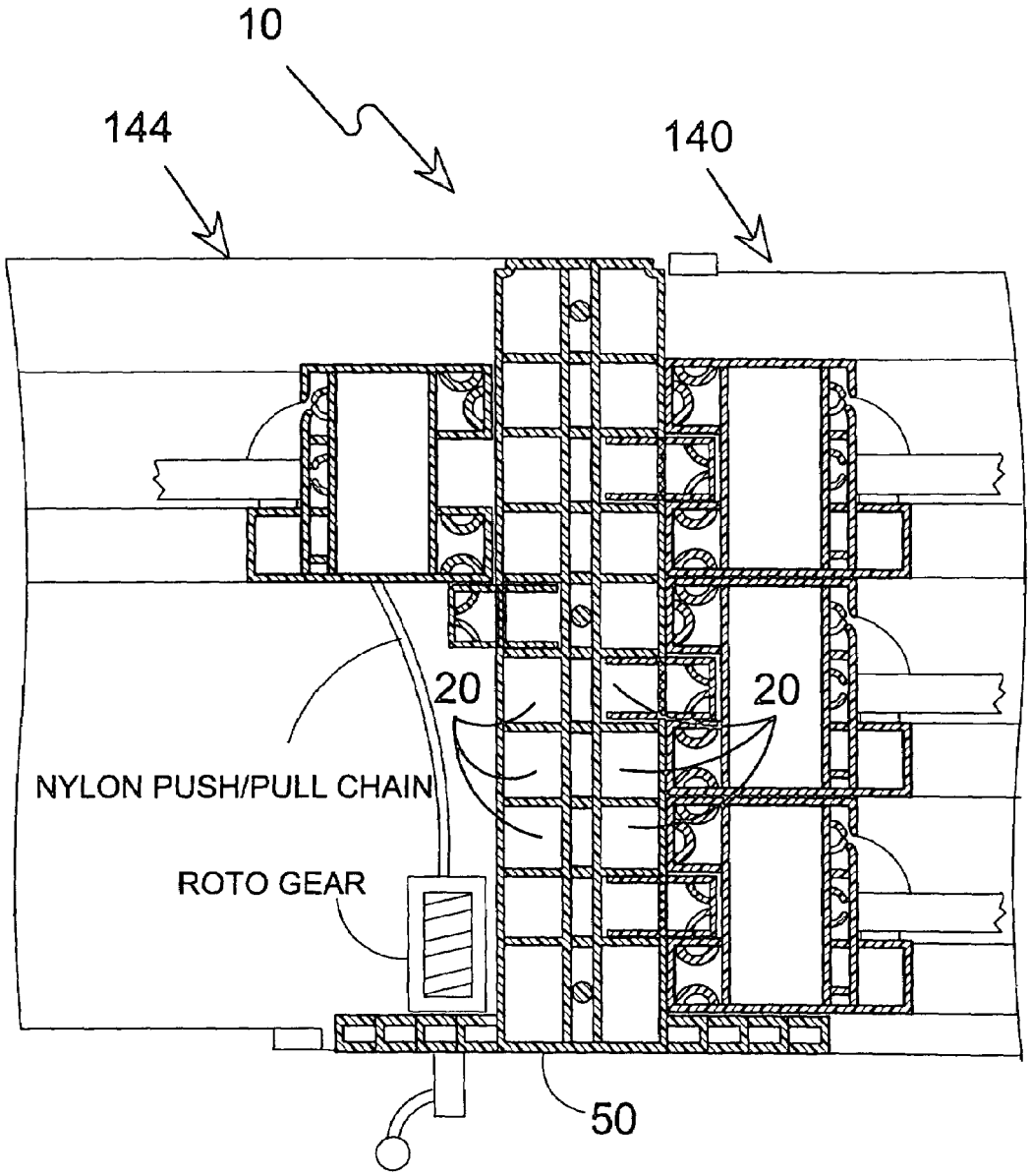
FIG. 31 is a sectional top view of a triple slider and casement window with roto gear.

Referring to FIG. 31, shown is a sectional top view of the dual window types of a triple slider 140 and casement window 144 having a common T-bar 50. Because the T-bar 50 has a plurality of mating opposed concealed tracks 20 the advantage of this system is the elimination of bonding one window frame to another. The present invention provides for the joining of various window types into a uniform assemblage with the various window types having a common glass line encompassed by a single frame.

Figure 32:
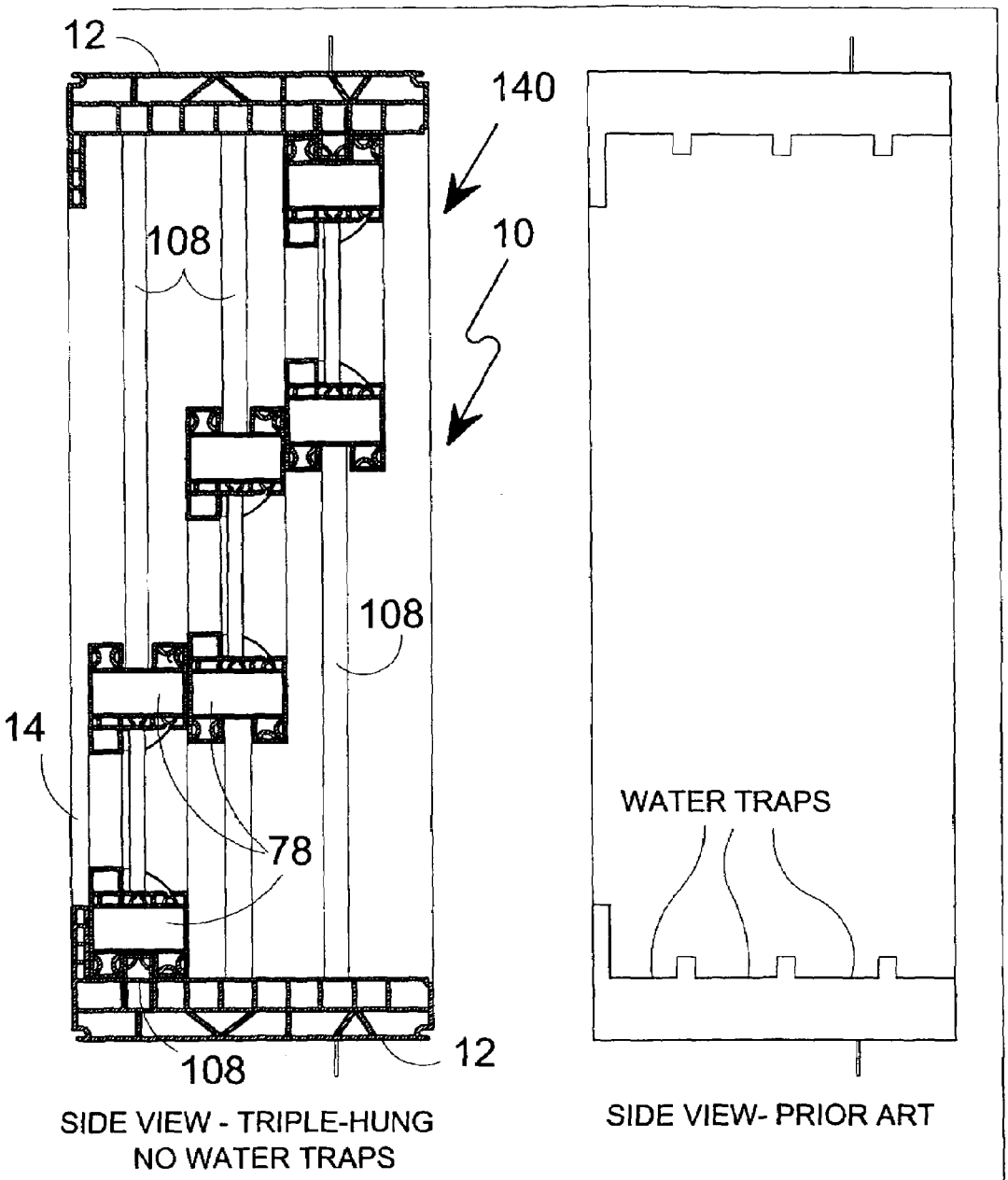
FIG. 32 is cross sectional side view of a triple hung window of the present invention and a side view of a triple hung window of the prior art.

FIG. 32 is cross sectional side view of a triple hung window 140 of the present invention and a side view of a triple hung window of the prior art. The triple hung window 140 has three vertically moving sashed 78 window member riding on three vertical frame insert 108 with one horizontal frame insert 108 situated in the front of the window adjacent the frame member flange 14. The plurality of concealed channels provides for the selective use by removal of the covering material when need. Otherwise the frame 12 of the present invention maintains a substantially planar surface with no tracks for water to accumulate in. Window frames that are known in the art include extruded guides that form channels that may accumulate water that can cause damage to the window. The present invention only uses the guides that are necessary for that particular application thereby reducing the risk of water accumulation.

Figure 33:
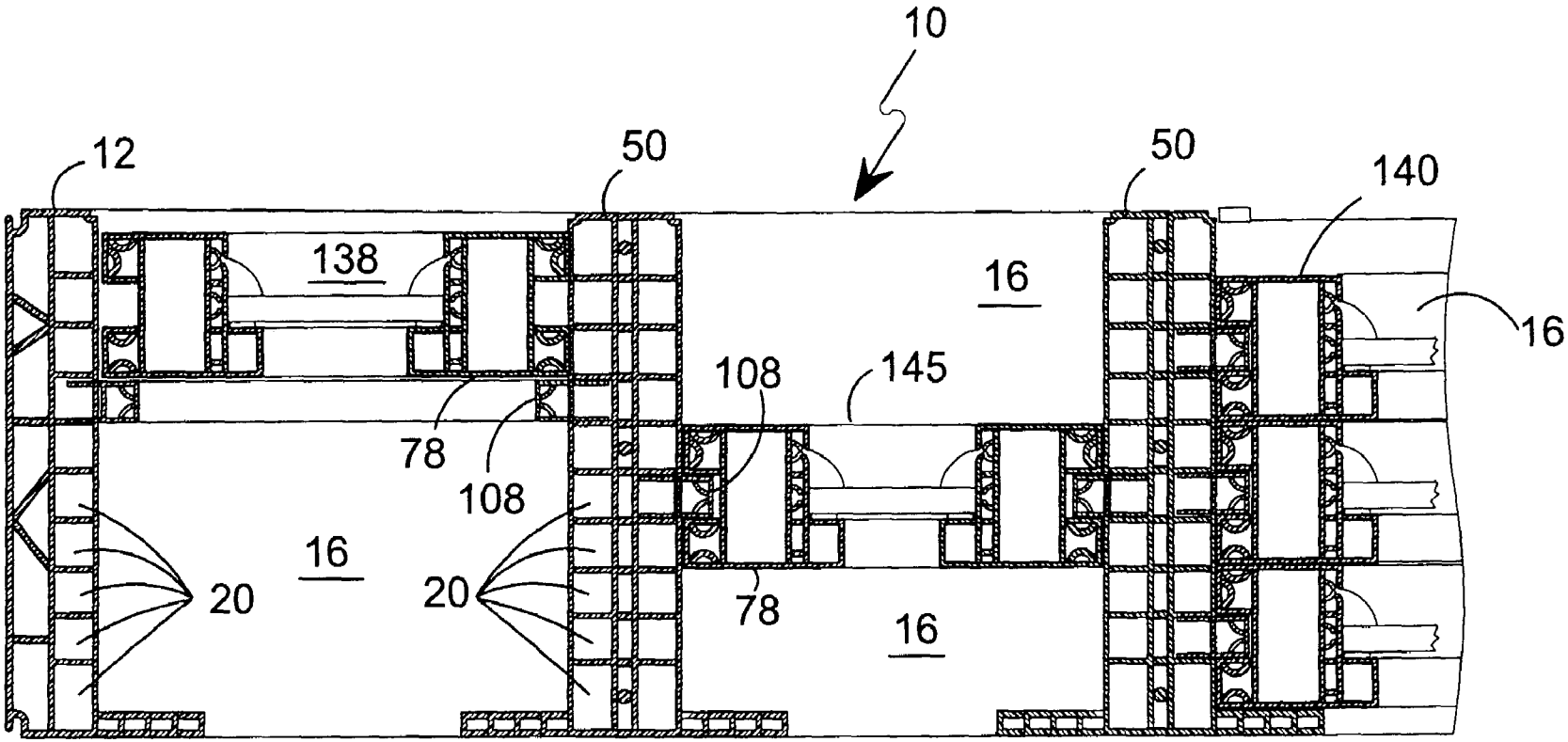
FIG. 33 is a cross sectional top view of a triple window frame set-up.

FIG. 33 is a cross sectional top view of a triple window frame set-up. Shown is a triple window having a common frame comprised of an awning window 138 on one side, a picture window 145 in the middle, and a triple hung window 140 on the other side. Because of the frame 12 having a plurality of concealed tracks 20 the placement of the various windows is selectable. Positioned between the windows is a t-bar 50 which conforms substantially to a frontal width 70 of twice the peripheral frame 38. The advantage of this system is the elimination of bonding one window frame to another where it would be difficult not to appear as a number of incongruous pieces. The present invention provides for the joining of various window types into a uniform assemblage with the various window types having a common glass line 178 encompassed by a singular frame 12.

Figure 34:
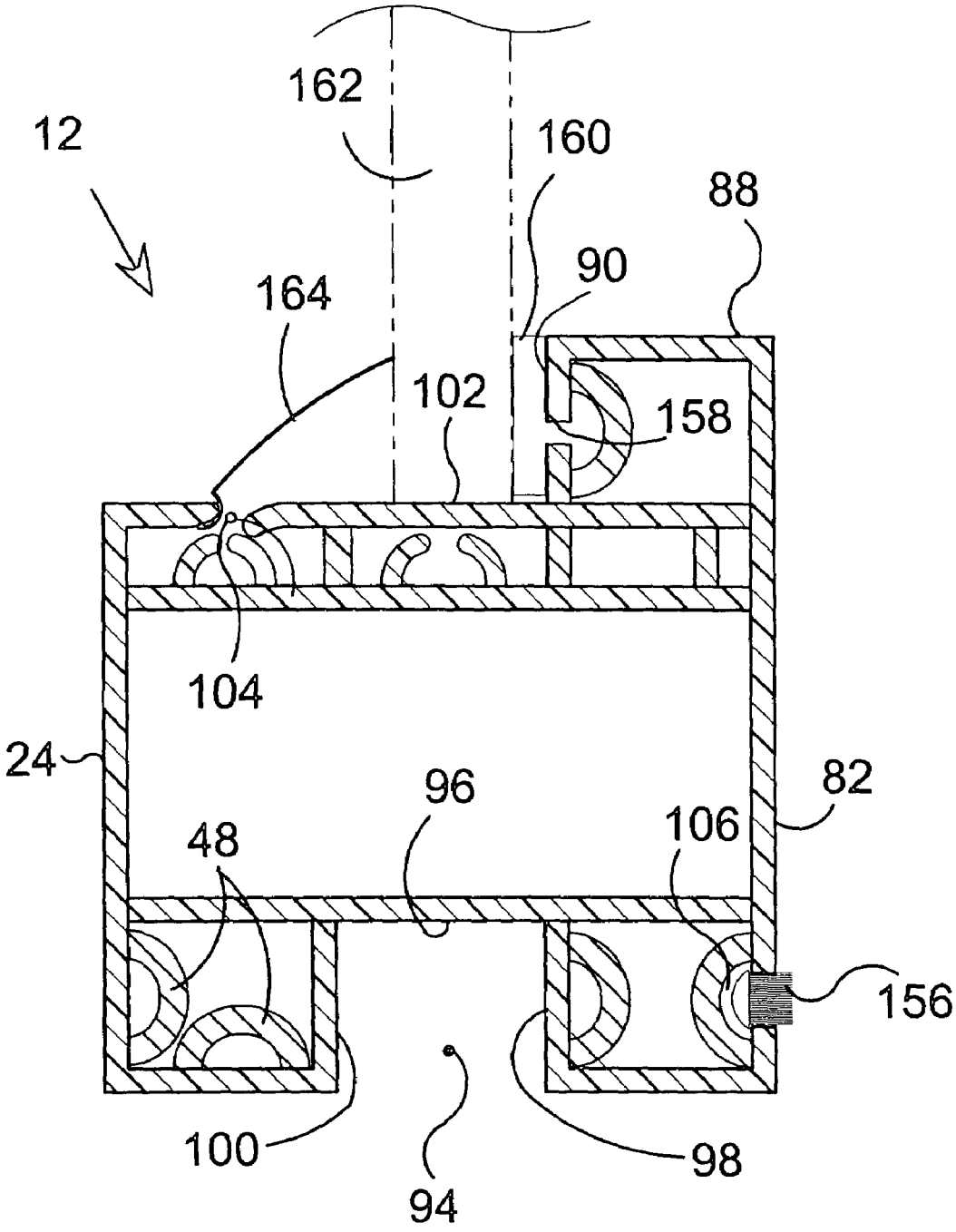
FIG. 34 is a sectional view of the window sash with additional components.

Referring to FIG. 34, shown is a sectional view of the window sash with additional components. While the sash is substantially a glass retaining member there are enhancements that can be selectively made to improve its functionally. The sash 78 is substantially h-shaped having spaced apart first wall 80 and second wall 82 with structural support 48 that serve as structural reinforcement and can be accessed to serve as retaining members for such things as weather stripping and screen spline. Machining to create a slot providing access to cavity 106 provides means for anchoring weatherstripping 156 therein. As seen in the illustration there are a number of such cavities that add functionality to the sash 78 that can be utilized during assemblage or during installation. The sash design anticipates a plurality of additional elements that can be used to enhance the capabilities of the sash 78. Additionally shown is the sash support surface 102 that functions as the means for holding the glass 160 in a semi-permanent position between the glass stop 90 having an adhesive 160 and glazing retaining groove 104 having glazing bead 164 therein. The sash also has a channel 94 that extends the length of the sash 78. The sash channel is comprised of a top surface 96, channel first wall 98 and channel second wall 100. The sash channel is design to mate with or hold other predetermined elements for a window type.

Figure 35:
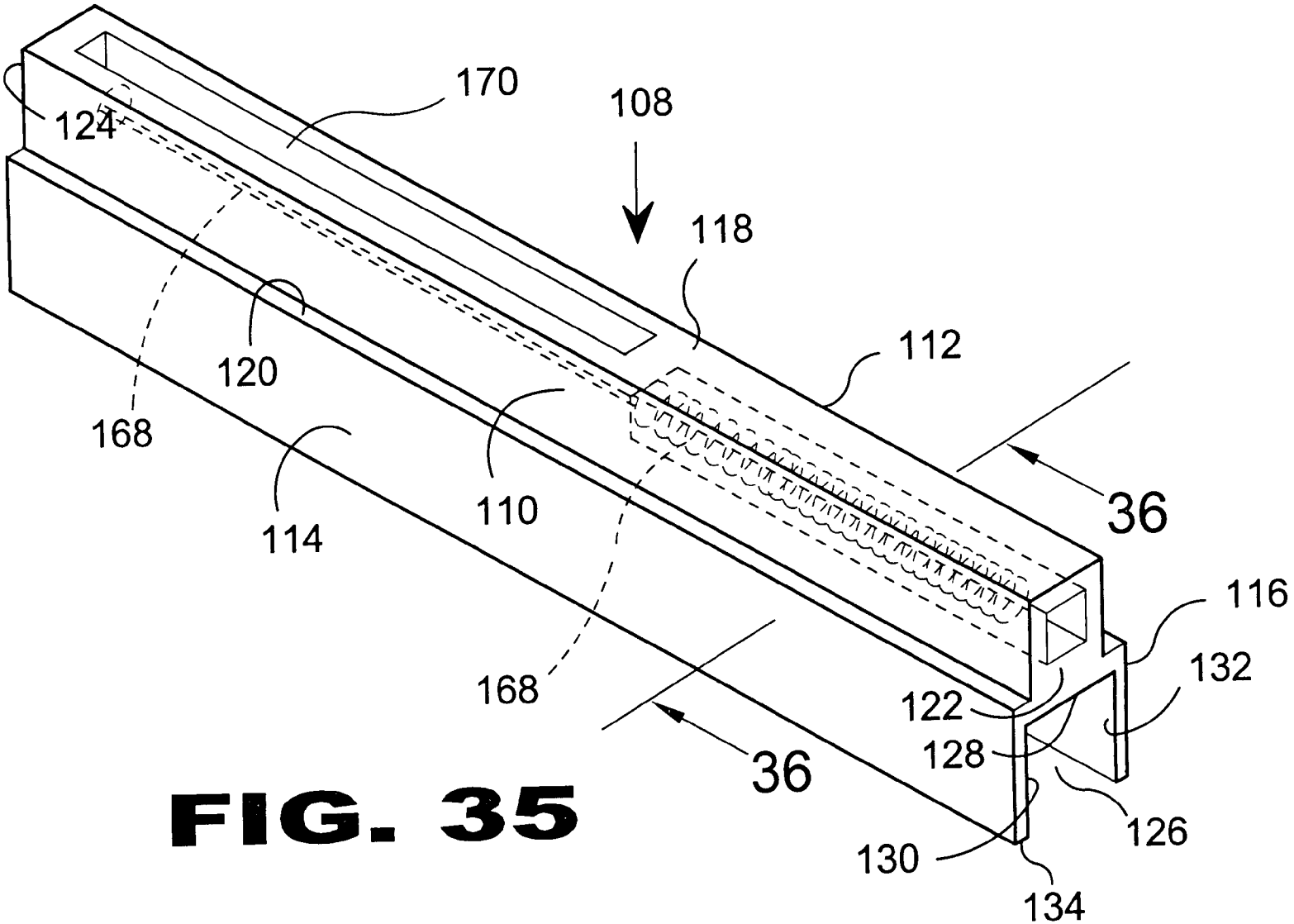
FIG. 35 is a perspective view of the frame insert with biasing means installed.

Referring to FIG. 35, shown is the frame insert having biasing means installed. The frame insert 108 is comprised of a frame insert upper first wall 110, upper second wall 112, and top surface 118 having aperture 170 for the placement therein of spring 168 and cord 166 which extends the use of the frame insert 108 having additional functions other than a track or stop. The frame insert also has a lower first wall 114, lower second wall 116 being spaced away from the upper walls by the frame insert ledge 120. The lower walls house the frame insert channel 126 having a top surface 128, channel first wall 130 and channel second wall 134. The channel 126 extends from the frame insert first distal end 122 to the frame insert second distal end 124.

Figure 36:
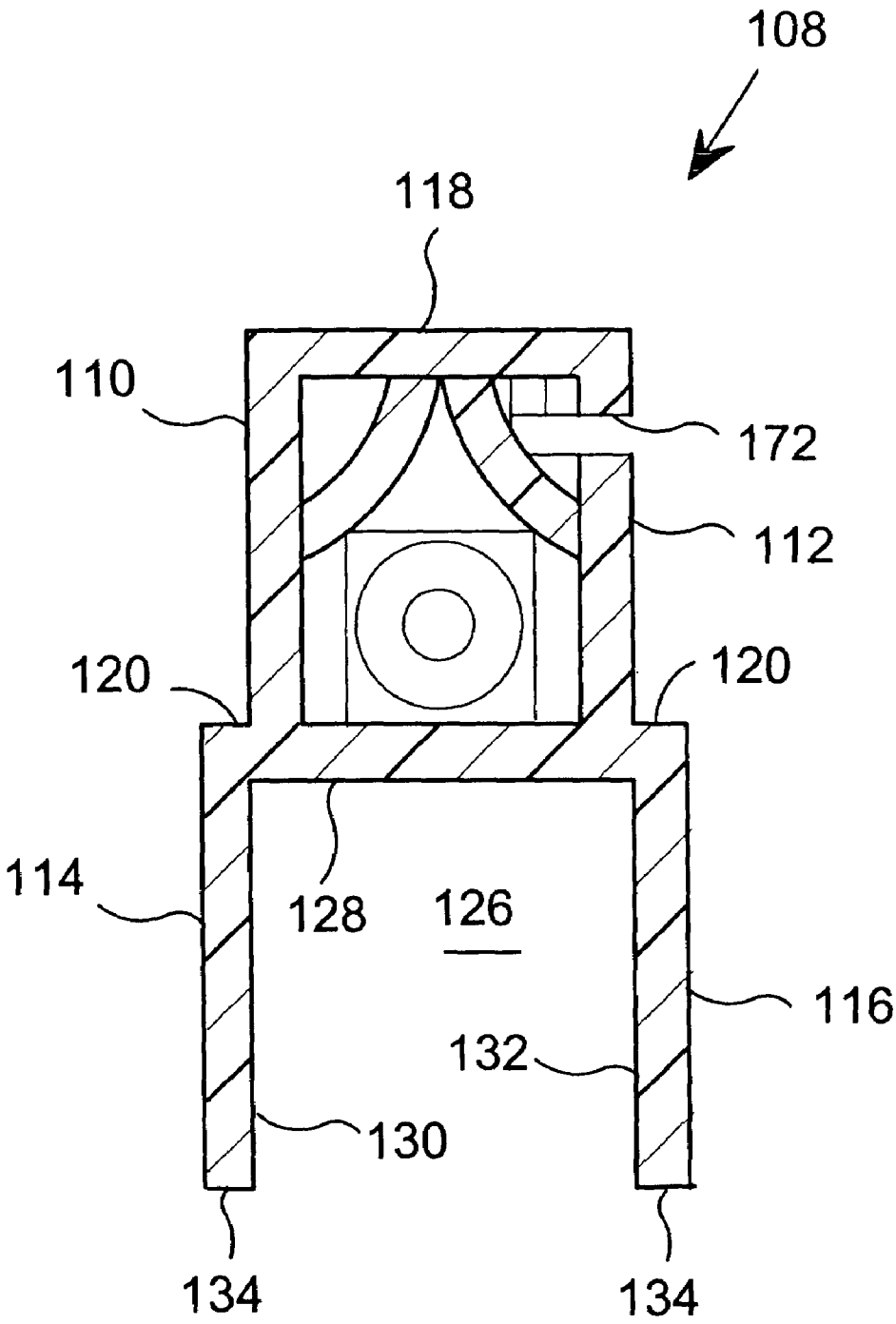
FIG. 36 is a cross sectional side view of the frame insert with counterweight hardware installed.

Referring to FIG. 36, shown is a cross sectional view taken from FIG. 35 as indicated. The frame insert 108 has been fabricated having counterweight hardware 174 positioned between the spaced apart upper first wall 110 and upper second wall 112 having a top surface 118 and a bottom surface 134. A channel 172 has been cut into the frame insert 108 for the insertion of weather stripping as required. The frame insert 108 also has spaced apart lower walls 114, 116 that are offset from the upper walls 110, 112 by a ledge 120. The lower wall 114, 116 house the frame insert channel 126 having a top surface 128, first channel wall 130 and second channel wall 132. Also shown is the frame insert bottom surface 134.

What is claimed is:

1. Modular components that can be used singularly or in combination to construct doors and/or windows comprising:

a) a frame member;

b) frame insert members;

c) sash members; and d) T-bar members, wherein the frame member is comprised of a substantially planar member having a flange extending longitudinally from one distal end to the other, and the frame member has a plurality of concealed channels, each having a base and spaced apart walls covered by one of the planar surfaces of the frame and one or more of the concealed channels can be selectively accessed by removal of the framing material covering the spaced apart walls of the concealed channel(s).

2. The frame member of claim 1, wherein the concealed channels, each having a base and spaced apart walls and covered by one of the planar exterior surfaces of the frame extend from one distal end of the frame to the other forming a throughbore in the frame.

3. The modular framing members of claim 1, wherein the frame insert member is comprised of two pairs of spaced apart walls with one pair of coplanar walls contained with the other pair of coplanar wall with each having a planar surface extending therebetween forming a top surface and wherein the larger pair of coplanar walls having a top surface forms the base for the smaller pair of spaced apart walls.

4. The frame insert member of claim 3, wherein the distance between the exterior surface of the greater spaced apart walls conforms substantially to the distance between the spaced apart walls of the concealed channels.

5. The frame insert of claim 3, wherein the height of the walls of the greater pair of spaced apart walls of the frame insert conforms substantially to the depth of an exposed concealed channel and wherein the top surface of the greater spaced apart walls of the frame insert is substantially coplanar with the top surface of the frame member after removal of material and placement into a concealed channel said frame insert.

6. The frame insert of claim 3, wherein a plurality of frame inserts can be placed within a plurality of frame member concealed channels wherein the exterior walls of each of the frame inserts engages the interior walls of their respective concealed channel having been exposed by removal of frame member surface material.

7. The modular framing members of claim 1, wherein the sash member is comprised of planar surfaces having two pairs of spaced apart walls having surfaces extending therebetween and wherein said structures a re spaced away from each other forming legs and where the opposing exterior surfaces extend vertically having a top and bottom surface and said top surface has another pair of spaced apart walls contained thereon with a top surface and longitudinally positioned on one side wherein one wall is coplanar with one of the exterior walls of the leg member and wherein the sash structure is substantially h-shaped.

8. The sash member of claim 7, wherein the distance between the interior walls of the spaced apart legs is substantially equal to the distance of the smaller exterior walls of the frame insert member.

9. The sash member of claim 8, wherein the height of the interior walls of the sash leg member's is dimensioned to the height of the smaller spaced apart walls of the frame insert member whereby said sash leg members can encompass said portion of said frame insert without the bottom of the leg members engaging the surface of the frame member when said frame insert is installed into one of the frame member's concealed channels.

10. The modular framing members of claim 1, wherein the T-bar member is comprised of planar surfaces having a flange extending perpendicularly above, below and extending longitudinally from one distal end to the other of the body of the T-bar having two rows of opposing concealed channels.

11. The T-bar members of claim 10, wherein the T-bar member has two rows of concealed channels, each channel having a base and spaced apart walls covered by either one or the other of the exterior planar surfaces of the T-bar.

12. The T-bar member of claim 11, wherein the concealed channels, each having a base and spaced apart walls and covered by one of the planar exterior surfaces of the frame extend from one distal end of the T-bar to the other forming a throughbore in the T-bar.

13. The T-bar member of claim 12, wherein one or more of the concealed channels can be selectively accessed by removal of the framing material covering the spaced apart walls of the concealed channel(s).

14. The frame member of claim 2 wherein the frame member can be used to form a peripheral frame for a transparent member.

15. The frame member of claim 2 wherein the frame member can be used to form a peripheral frame for a translucent member.

16. The frame member of claim 2 wherein the frame member can be used to form a peripheral frame for an opaque member.

17. The T-bar member of claim 13 and the frame member of claim 2 whereby the combination can be used to create a unitary framed member having a plurality of framed compartments for the placement therein of a plurality of different window types.

18. The sash member of claim 9 wherein the sash member and frame member of claim 2 can be used to form a peripheral frame for a transparent member.

19. The sash member of claim 9 wherein the sash member and frame member of claim 2 can be used to form a peripheral frame for a translucent member.

20. The sash member of claim 9 wherein the sash member and frame member of claim 2 can be used to form a peripheral frame for an opaque member.

21. The frame insert of claim 6 wherein the frame insert of claim 6, sash member of claim 9 and frame member of claim 2 can be used to form a peripheral frame for a transparent member.

22. The frame insert of claim 6 wherein the frame insert of claim 6, sash member of claim 9 and frame member of claim 2 can be used to form a peripheral frame for a translucent member.

23. The frame insert of claim 6 wherein the frame insert of claim 6, sash member of claim 9 and frame member of claim 2 can be used to form a peripheral frame for an opaque member.

24. The T-bar of claim 13 wherein the T-bar and frame member of claim 2 can be used to form a unitary frame having a plurality of compartments where in combination with the frame insert of claim 6 and sash member of claim 9 a plurality of different window types can be created having a combination of transparent members.

25. The T-bar of claim 13 wherein the T-bar and frame member of claim 2 can be used to form a unitary frame having a plurality of compartments where in combination with the frame insert of claim 6 and sash member of claim 9 a plurality of different window types can be created having a combination of translucent members.

26. The T-bar of claim 13 wherein the T-bar and frame member of claim 2 can be used to form a unitary frame having a plurality of compartments where in combination with the frame insert of claim 6 and sash member of claim 9 a plurality of different window types can be created having a combination of opaque members.

27. The T-bar of claim 13 wherein the T-bar and frame member of claim 2 can be used to form a unitary frame having a plurality of compartments where in combination with the frame insert of claim 6 and sash member of claim 9 a plurality of different window types can be created having a combination of transparent, translucent and opaque members and wherein said windows types can have common glass lines either vertically and/or horizontally.

* * * * *